US010882348B2

(12) United States Patent
Boxhammer et al.

(10) Patent No.: US 10,882,348 B2
(45) **Date of Patent: *Jan. 5, 2021**

(54) HEAT-SENSITIVE RECORDING MATERIAL

(71) Applicant: MITSUBISHI HITEC PAPER EUROPE GMBH, Bielefeld (DE)

(72) Inventors: Claas Boxhammer, Herford (DE); Martin Schreer, Melle (DE)

(73) Assignee: Mitsubishi HiTec Paper Europe GmbH, Bielefeld (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/340,006

(22) PCT Filed: Sep. 29, 2017

(86) PCT No.: PCT/EP2017/074879

§ 371 (c)(1),
(2) Date: Apr. 5, 2019

(87) PCT Pub. No.: WO2018/065330

PCT Pub. Date: Apr. 12, 2018

(65) Prior Publication Data

US 2020/0039271 A1 Feb. 6, 2020

(30) Foreign Application Priority Data

Oct. 7, 2016 (DE) ..... 10 2016 219 567
Oct. 7, 2016 (DE) ..... 10 2016 219 569
Oct. 7, 2016 (EP) ..... 16192933

(51) Int. Cl.
*B41M 5/333* (2006.01)
*B41M 5/323* (2006.01)
(Continued)

(52) U.S. Cl.
CPC ..... *B41M 5/3333* (2013.01); *B41M 5/323* (2013.01); *B41M 5/42* (2013.01);
(Continued)

(58) Field of Classification Search
CPC ..... B41M 5/323; B41M 5/3333
See application file for complete search history.

(56) References Cited

U.S. PATENT DOCUMENTS

2005/0148467 A1 7/2005 Makitalo et al.
2016/0236496 A1* 8/2016 Morie ..... B41M 5/44
2018/0022136 A1 1/2018 Sakai et al.

FOREIGN PATENT DOCUMENTS

DE 10 2004 004 204 8/2005
DE 10 2014 107 567 11/2015
(Continued)

OTHER PUBLICATIONS

Claudia Caltagirone et al. "Anion binding 1-4 vs. sulfonamide deprotonation in functionalized ureas", Chemical Communications, Nr. 1, 25. Oct. 25, 2007, pp. 61-63, XP055212087.

*Primary Examiner* — Gerard Higgins
(74) *Attorney, Agent, or Firm* — Cozen O'Connor

(57) ABSTRACT

A heat-sensitive recording material having i) a supporting substrate and ii) a heat-sensitive recording layer, where the heat-sensitive recording layer comprises a colour former and a colour developer mixture and the colour developer mixture comprises a) N-[2-(3-phenylureido)phenyl]benzenesulfonamide (compound of the formula (I)), where the compound of the formula (I) is in a crystalline form having an absorption band at 3401 □ 20 cm 1 in the IR spectrum, and b) N-(4-methylphenylsulfonyl)-N'-(3-(4-methylphenylsulfonyloxy)phenyl) urea (compound of the formula (II)), where
(Continued)

the mass ratio between the compound of the formula (I) and the compound of the formula (II) is 0.5:99.5 to 35:65 or 99.5:0.5 to 65:35.

11 Claims, 9 Drawing Sheets

(51) Int. Cl.

| | |
|---|---|
| ***B41M 5/42*** | (2006.01) |
| *B41M 5/337* | (2006.01) |
| *B41M 5/327* | (2006.01) |
| *B41M 5/44* | (2006.01) |

(52) U.S. Cl.
CPC ..... *B41M 5/3275* (2013.01); *B41M 5/3372* (2013.01); *B41M 5/426* (2013.01); *B41M 5/44* (2013.01); *B41M 2205/04* (2013.01); *B41M 2205/38* (2013.01)

(56) References Cited

FOREIGN PATENT DOCUMENTS

| | | | | |
|---|---|---|---|---|
| DE | 10 2015 104 306 | | 9/2016 | |
| EP | 1 140 515 | | 10/2001 | |
| EP | 2 923 851 | | 9/2015 | |
| EP | 3 109 059 | | 12/2016 | |
| JP | 2014/218062 | | 11/2014 | |
| JP | 2015500868 | | 3/2015 | |
| WO | WO-2015050098 | A1 * | 4/2015 | ..... B41M 5/3372 |
| WO | WO 2016/136203 | | 9/2016 | |

* cited by examiner

HEAT-SENSITIVE RECORDING MATERIAL

CROSS REFERENCE TO RELATED APPLICATIONS

This is a U.S. national stage of application No. PCT/EP2017/074879, filed on Sep. 29, 2017. Priority is claimed on German Application Nos. DE102016219567.0, filed Oct. 7, 2016; DE102016219569.7, filed Oct. 7, 2016; and European Application No. EP 16192933.6, filed Oct. 7, 2016, the content of which are incorporated herein by reference.

BACKGROUND OF THE INVENTION

1. Field of the Invention

The present invention relates to a heat-sensitive recording material comprising a) a compound of the formula (I) and b) a compound of the formula (II), to a use of the heat-sensitive recording material, and to a method for producing a heat-sensitive recording material.

2. Description of the Prior Art

Heat-sensitive recording materials have been known for many years and enjoy considerable popularity. This popularity can be attributed, inter alia, to the fact that their use is associated with the advantage that the colour-forming components are present in the recording material itself and therefore printers without toner and ink cartridges may be used. It is therefore no longer necessary to purchase, to stock, to change, or to replenish toner cartridges or ink cartridges. Hence, this innovative technology has been accepted largely comprehensively, in particular in public transport and in the retail trade.

However, in the recent past doubts have increasingly been raised against the environmental compatibility in particular of certain (colour) developers, also designated as colour acceptors, partly also of dyestuff precursors, with which the (colour) developers react with a heat supply for formation of visually detectable colour, which cannot be ignored by the industry and in particular by the trade. Hence, recently for the (colour) developers, for example the well-known components investigated scientifically as excellent, known as

- bisphenol A, which is 2,2-bis(4-hydroxyphenyl)-propane, and
- bisphenol S, which is 4,4'-dihydroxydiphenyl sulfone, are increasingly at the center of public criticism and are therefore from time to time replaced by

- Pergafast® 201, which is N-(4-methylphenylsulfonyl)-N'-(3-(4-methylphenylsulfonyloxy)phenyl) urea, from BASF SE,
- D8, which is 4-hydroxy-4'-isopropoxydiphenyl sulfone,
- N-[2-(3-phenylureido)phenyl]benzenesulfonamide and
- N-{2-[(phenylcarbamoyl)amino]phenyl} benzenesulfonamide.

With the aim of improving heat-sensitive recording materials, in particular as regards their use as tickets or lottery tickets with regard to their resistance to environmental influences, such as heat, moisture, and chemicals, the underlying chemistry and the production technology has been developed more and more to generate such recording materials.

To increase the resistance of a thermal print-out (heat-induced recording), which can be obtained on a heat-sensitive recording material with respect to water, aqueous alcohol solutions and plasticisers, DE 10 2004 004 204 A1 proposes a heat-sensitive recording material, the heat-sensitive recording layer of, which has conventional dyestuff precursors and the combination of a phenolic colour developer and a colour developer based on urea-urethane.

DE 10 2015 104 306 A1 describes a heat-sensitive recording material which comprises a supporting substrate and a heat-sensitive colour-forming layer containing at least one colour former and at least one phenol-free colour developer, where for example N-phenyl-N' [(phenylamino)sulfonyl] urea, N-(4-methylphenyl)-N' [(4-ethylphenylamino)sulfonyl] urea, N-(4-ethoxycarbonylphenyl)-N' [(4-ethoxycarbonylphenylamino)sulfonyl] urea or structurally similar compounds are used as phenol-free colour developers.

JP 2014-218 062 A describes a heat-sensitive recording material having a heat-sensitive recording layer, which comprises at least one leuco-dyestuff and one colour developer on the support. A mixture of 4,4'-bis(3-tosylureido) diphenylmethane and N-[2-(3-phenylureido)phenyl]benzenesulfonamide is used as a colour developer.

International patent application WO 2016/136 203 A1 describes a crystalline form of N-(2-(3-phenylureido)phenyl)phenylsulfonamides and the use of this crystalline form in a recording material. The crystalline form is characterized by detail of diffraction reflections in an X-ray powder diffractogram or diffraction pattern and by the melting point and thus differ from other crystalline forms of this compound. It is additionally mentioned that the crystalline forms may likewise be distinguished from one another by the absorption bands in the IR spectrum. It is also shown that different crystalline forms of a compound may lead to different properties of the recording materials produced using this compound.

The object of US 2005/0148 467 A1 is a heat-sensitive recording material that comprises at least the components of two colour-forming systems to form an irreversible printed image, where the one system is of the chelate type and the other a conventional leuco-dyestuff system.

However, there is a constant need for further heat-sensitive recording materials for the widest variety of uses, where they have to be able to be produced with low production costs due to high sales quantities in a fiercely contested market and therefore have to have a simple structure. A further challenge consists in that a printed heat-sensitive recording material in its typical uses as a ticket, entrance ticket, travel ticket, pay and display ticket, and the like, are exposed to a number of different environmental influences, such as moisture, heat or chemicals. Hence, heat-sensitive recording materials may come into contact with a number of different substances during normal use which may influence the resistance of the thermal print-out. These include, in addition to water and organic solvents, also greases and oils, which are present, for example in hand-care products, and may be transferred to the heat-sensitive recording material during contact with the latter. In particular the resistance with respect to greases and oils is therefore very relevant.

In addition to the resistance with respect to chemicals, which may come into contact with the heat-sensitive recording materials, heat-sensitive recording materials also have to have high resistance with respect to thermal influences. On the one hand, the heat-sensitive recording material should be able to be printed in an energy-conserving and easy manner to consume little energy, for example for mobile applications. On the other hand, the printed image should be retained after printing and neither should the printed image fade during the action of heat, nor should the unprinted background become discoloured, which would lead to the print no longer being legible. For example in the case of pay and display tickets which are kept behind the windscreen after printing and thus in summer are exposed to high temperatures and direct solar radiation, the thermal resistance is extremely relevant.

Also for tickets, such as concert tickets or flight tickets, which often are issued a long time in advance, or for receipts or proofs of purchase which are required as evidence of purchase over a long period of guarantee, the long-term resistance of the heat-sensitive recording material is very important. Particularly if it must be assumed that the heat-sensitive recording materials may come into contact with moisture, as for example being kept close to the body (e.g. in the trouser pocket) as a concert ticket, flight ticket or proof of purchase, and may consequently come into contact with perspiration, it is necessary to ensure that the recorded materials remain readily legible even after contact with moisture.

In the past it has emerged that recording materials with N-(4-methyl-phenylsulfonyl)-N-(3-(4-methylphenylsulfonyloxy)phenyl) urea (Pergafast® 201) as (colour) developers do exhibit good resistance towards fats and oils but do not have satisfactory long-term stability with respect to effects of heat, particularly under high atmospheric humidity.

It has also emerged that recording materials with N-[2-(3-pheny-lureido)phenyl]benzenesulfonamide as (colour) developers do exhibit good resistance towards effects of heat, particularly under high atmospheric humidity, but do not have satisfactory resistance with respect to fats and oils.

SUMMARY OF THE INVENTION

There is therefore a constant need for an improvement of the resistance of the thermal print-out with respect to various environmental influences. An object of one aspect of the present invention is providing a heat-sensitive recording material which in the printed state, has a high resistance with respect to environmental influences, such as moisture, heat, or chemicals.

The heat-sensitive recording materials in the printed state are preferably to have a high long-term resistance to moisture and heat, without detriment to the resistance towards fats and oils, and/or are resistant to fats and oils in the printed state, while at the same time having a high long-term resistance to ambient influences, such as moisture and heat or chemicals.

The heat-sensitive recording materials should particularly preferably have low long-term ageing even at high temperatures (40 to 60° C.) and high air humidity and thus have a resistance with respect to grease which is improved with respect to the state of the art or which is at least constant.

One object of the invention is a heat-sensitive recording material comprising:

i) a supporting substrate and ii) a heat-sensitive recording layer, where the heat-sensitive recording layer comprises a colour former and a colour developer mixture, and the colour developer mixture comprises a) a compound of the formula (I)

(I)

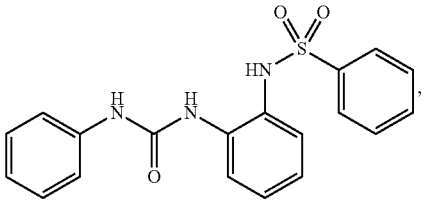

where the compound of the formula (I) is in a crystalline form having an absorption band at 3401±20 $cm^{-1}$ in the IR spectrum, and b) a compound of the formula (II)

(II)

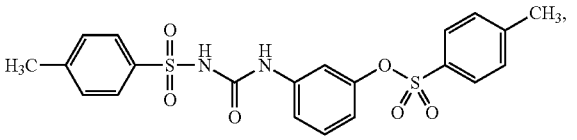

where i) the mass ratio between the compound of the formula (I) and the compound of the formula (II) is 0.5:99.5 to 35:65 or ii) the mass ratio between the compound of the formula (I) and the compound of the formula (II) is 99.5:0.5 to 65:35.

The compound with the formula (II) is the already known compound N-(4-methylphenylsulfonyl)-N'-(3-(4-methylphenylsulfonyloxy)phenyl) urea, which is sold under the designation Pergafast 201 and is described, for example in EP 1 140 515 BI. Pergafast 201 is the most frequently used phenol-free colour developer.

The compound with the formula (I) is likewise already known and is described, for example in EP 2 923 851 A1. It is sold under the designation NKK. However, it has been shown that the compound of the formula (I) may be in two different crystalline forms. Both crystalline forms have different physical properties, which may have influences on the heat-sensitive recording material.

One crystalline form of the compounds with the formula (I) has a melting point of about 158° C., whereas the second crystalline form of the compounds with the formula (I) used according to the invention has a melting point of 175° C. In connection with heat-sensitive recording materials, hitherto only the compound with the formula (I) has been described in the literature, which is the crystalline form having a melting point of about 158° C. (see for example EP 2 923 851 A1 paragraph [0084]). Neither the production nor the use of the crystalline form of the compounds with the formula (I) used according to the invention having a melting point of about 175° C. are described in the literature. Accordingly, it must be assumed that the crystalline form of the compound with the formula (I) having a melting point of about 158° C. has always been used, even if the melting point is not explicitly mentioned in the corresponding document. The crystalline form of the compound of the formula (I) used according to one aspect of the invention having a melting point of 175° C. has also been obtainable commercially for a short while.

According to one aspect of the invention, a heat-sensitive recording material is therefore preferred, where the crystalline form of the compound of the formula (I) has a (preferably endothermic) transition at a temperature between 170° C. and 178° C., preferably between 173° C. and 177° C., more preferably between 174° C. and 176° C., determined by means of dynamic differential calorimetry (DKK) at a heating rate of 10 K/minute.

Both crystalline forms of the compounds with the formula (I) can likewise be distinguished from one another in the IR absorption spectrum. Particularly characteristic for the crystalline form of the compounds with the formula (I) used according to one aspect of the invention is an absorption band at 3401±20 $cm^{-1}$ in the IR spectrum. For the crystalline form of the compounds with the formula (I), which has a melting point of about 158° C., this band is not present, but in each case a band at 3322 and 3229 $cm^{-1}$.

According to one aspect of the invention, a heat-sensitive recording material is preferred, where the crystalline form of the compound of the formula (I) has absorption bands at 689±10 $cm^{-1}$, 731±10 $cm^{-1}$, 1653±10 $cm^{-1}$ 3364±20 $cm^{-1}$ and 3401±20 $cm^{-1}$ in the IR spectrum.

According to one aspect of the invention, a heat-sensitive recording material is preferred, where the IR absorption spectrum of the crystalline form of the compound of the formula (I) concurs substantially with the IR absorption spectrum shown in FIG. 1*a*), 2*a*), and/or 3*a*).

Both crystalline forms of the compounds with the formula (I) can likewise be distinguished from one another in an X-ray powder diffractogram or diffraction pattern. According to one aspect of the invention, a heat-sensitive recording material is preferred, where the crystalline form of the compound of the formula (I) has an X-ray powder diffractogram with diffraction reflections at ° 20 values of 10.00±0.20, 11.00±0.20, 12.40±0.20, 13.80±0.20, and 15.00±0.20.

According to one aspect of the invention, a heat-sensitive recording material is preferred, where the crystalline form of the compound of the formula (I) has an X-ray powder diffractogram which concurs substantially with the X-ray powder diffractogram shown in FIG. 4*b*).

The crystalline form which has an absorption band at 3401±20 $cm^{-1}$ in the IR spectrum or has a melting point of 175° C. or a transition at a temperature between 170° C. and 178° C. (determined by dynamic differential calorimetry (DKK) at a heating rate of 10 K/minute) or diffraction reflections at ° 20 values of at least 10.00±0.20, 11.00±0.20, 12.40±0.20, 13.80±0.20, and 15.00±0.20 in the X-ray powder diffractogram, provided the presence of the other crystal structure is not explicitly described, is always described within the scope of this text under a compound of the formula (I).

It goes without saying that the detail a) of the melting point, b) of the diffraction reflections in the X-ray powder diffractogram or c) of the absorption bands in the IR spectrum serve only to describe the crystalline form of the compound and thus facilitate distinguishing this crystalline form from other crystalline forms of the compound. The detail of one of these measured quantities is thus conventionally already enough to carry out differentiation of the various crystalline forms. The detail of the absorption bands in the IR spectrum is thus particularly preferred, since an IR spectrum may be measured very easily for the expert and with high reproducibility and IR spectrometers belong to the standard equipment in the chemical laboratory.

It has surprisingly emerged that the additional small amounts of the compound of the formula (I) to the compound of the formula (II) significantly improves the moisture resistance even over prolonged periods, while the already good resistance of the compound of the formula (II) to fats and oils is retained.

It has likewise surprisingly emerged that the addition of small amounts of the compound of the formula (II) to the compound of the formula (I) significantly improves the resistance to fats and oils, while the already good moisture resistance of the compound of the formula (I) is also retained over prolonged periods.

Specifically in relation to the resistance at high temperatures (60° C.) it has emerged that the printed image from heat-sensitive recording materials of the invention wherein the mass ratio between the compound of the formula (I) and the compound of the formula (II) is 0.5:99.5 to 35:65 decreases less, even after storage for 24 hours at 60° C., than in the case of heat-sensitive recording materials wherein the colour developer mixture has been replaced with equal parts by weight by a compound of the formula (I). In some cases the printed image from heat-sensitive recording materials of the invention after storage for 24 hours at 60° C. has a higher printing density than for heat-sensitive recording materials in which the colour developer mixture has been replaced in equal parts by weight by a compound of the formula (I) or (II). The combination, used in accordance with the invention, of a compound of the formula (I) with a compound of the formula (II) therefore has a synergistic effect which was not predictable and is therefore completely surprising.

Surprisingly it has likewise emerged that the compound with the formula (I) is more biodegradable than the compound of the formula (II). By replacing some of the compound of the formula (II) with a compound of the formula (I), therefore, it is possible to improve the biodegradability of the colour developer mixture used for producing heat-sensitive recording materials, while an additional of smaller amounts (up to 35%) of the compound of the formula (II) to the compound of the formula (I) does not significantly impair the biodegradability of the colour developer mixture used for producing heat-sensitive recording materials.

Preferred in accordance with one aspect of the invention is a heat-sensitive recording material wherein the ageing of the heat-sensitive recording material is less under storage for 24 hours at 40° C. and 90% relative air humidity than the ageing of a heat-sensitive recording material in which the colour developer mixture has been replaced in equal parts by weight by a compound of the formula (II).

Likewise preferred in accordance with one aspect of the invention is a heat-sensitive recording material wherein the ageing of the heat-sensitive recording material is less under storage for 24 hours at 60° C. than the ageing of a heat-sensitive recording material in which the colour developer mixture has been replaced in equal parts by weight by a compound of the formula (I) or preferably a compound of the formula (II).

The ageing of the heat-sensitive recording material is regarded as lower if the print density of a printed region decreases less strongly than in the comparison sample.

Likewise preferred in accordance with one aspect of the invention is a heat-sensitive recording material wherein the resistance of the heat-sensitive recording material to lanoline after 14 days is higher than or the same as the resistance of a heat-sensitive recording material wherein the colour developer mixture has been replaced in equal parts by weight by a compound of the formula (II).

The resistance of the heat-sensitive recording material with respect to lanoline is regarded as higher if the print density of a printed region decreases less strongly than in the comparison sample.

It is known to the expert that the combination of various developers, such as compounds of the formula (I) or (II), conventionally leads to an impairment of the properties of the heat-sensitive recording material. Conventionally, the combination of two or more developers leads to an unwanted change in the colour of the heat-sensitive recording material, so that the heat-sensitive recording material has, for example, a grey effect, without the other properties being improved. Accordingly, the expert would have to achieve the object described above in the test, not considered, to combine various developers with one another and corresponding tests not carried out. Also for this reason, the solution of the invention shown here is surprising, since to achieve the object, the expert would have to overcome first of all the technical prejudice that two developers should not be combined with one another.

In a first design of the present invention, a heat-sensitive recording material is preferred according to the invention, where the mass ratio between the compound of the formula (I) and the compound of the formula (II) is 5:95 to 30:70, preferably 15:85 to 25:75.

In our own investigations it has been shown that mixtures having a mass ratio between the compound of the formula (I) and the compound of the formula (II) of about 20:80 or in the ranges defined above from 5:95 to 30:70, preferably 15:85 to 25:75, have a synergistic effect with regard to improved resistance for at least 24 hours at 60° C. Heat-sensitive recording materials which have, as a colour developer mixture, mixtures with these mass ratios show better properties than heat-sensitive recording materials in which the colour developer mixture has been replaced in equal parts by weight by only one compound of the formula (II) or (I).

In a second design of the present invention, a heat-sensitive recording material is preferred according to the invention, where the mass ratio between the compound of the formula (I) and the compound of the formula (II) is 97:3 to 85:15, preferably 95:5 to 90:10.

In our own investigations it has emerged that mixtures having a mass ratio between the compound of the formula (I) and the compound of the formula (II) of about 93:7 or in the ranges defined above from 97:3 to 85:15, preferably 95:5 to 90:10, have particularly good properties with regard to resistance for at least 24 hours at 60° C. and an improved resistance to fat (especially lanoline). Heat-sensitive recording materials which, as a colour developer mixture, comprise mixtures having these mass ratios show better properties (moisture resistance or fat resistance) than heat-sensitive recording materials in which the colour developer mixture has been replaced in equal parts by weight by only one compound of the formula (II) or (I).

Surprisingly it has emerged that in heat-sensitive recording materials of the invention wherein the mass ratio between the compound of the formula (I) and the compound of the formula (II) is 99.5:0.5 to 65:35 there is no observed greying of the unprinted recording material. Particularly for a mass ratio between the compound of the formula (I) and the compound of the formula (II) of 99:1 to 75:25, there is no relevant greying of the unprinted recording material. This mixing ratio is therefore preferred.

According to one aspect of the invention, a heat-sensitive recording material is preferred, where the supporting substrate is a paper, synthetic paper, or a polymeric film. A non-surface-treated coated base paper is particularly preferred as supporting substrate, since it has good ability for recycling and good environmental compatibility. A non-surface-treated coated base paper is understood to mean a coated base paper which has not been treated in a size press or in a coating device. Films made of polypropylene or other polyolefins are preferred as polymeric films. According to the invention, papers which are coated with one or more polyolefins (in particular prolypropylene) are also preferred.

In a more particularly preferred design variant, the supporting substrate is a paper with a fraction of recycled fibres of at least 70 wt %, based on the total fibrous material fraction in the paper.

According to one aspect of the invention, a heat-sensitive recording material is preferred, further comprising an interlayer located between the supporting substrate and the heat-sensitive recording layer, where the interlayer preferably comprises pigments. The pigments may be organic pigments, inorganic pigments, or a mixture of organic pigments and inorganic pigments.

It is preferred according to the invention if the mass of the interlayer per unit area is in the range from 5 to 20 g/m$^2$, preferably in the range from 7 to 12 g/m$^2$.

In the case that the interlayer comprises pigments, it is preferred in one design of the invention if the pigments are organic pigments, preferably organic hollow-body pigments.

Separate investigations have shown that binding of organic pigments into the interlayer is advantageous, since organic pigments have high heat-reflecting capacity. Due to increased heat reflection of the interlayer formed with organic pigments, the response of the heat-sensitive recording layer with respect to heat is increased, since the irradiated heat is reflected at least partly into the heat-sensitive recording layer, instead of guiding it to the supporting substrate. The sensitivity and the resolution of the heat-sensitive recording material is thus significantly increased and furthermore the printing speed in the thermal printer is increased. In addition, the energy consumption may be lowered during the printing process, which is advantageous particularly for mobile devices. Hollow-body pigments have air in their interior, whereby they conventionally have an even higher heat reflection and the sensitivity and the resolution of the heat-sensitive recording material may be increased still further.

In the case that the interlayer comprises pigments, in an alternative design of the invention it is preferred if the pigments are inorganic pigments, preferably selected from the list consisting of calcined kaolin, silicon oxide, bentonite, calcium carbonate, aluminium oxide and boehmite.

If inorganic pigments are bound into the interlayer located between the recording layer and the substrate, these pigments may absorb the constituents (for example waxes) of the heat-sensitive recording layer liquefied by the action of heat of the thermal head during script formation and thus favour an even more safe and rapid mode of operation of the heat-induced recording.

It is particularly advantageous if the inorganic pigments of the interlayer have an oil absorption of at least 80 cm$^3$/100 g and even better of 100 cm$^3$/100 g, determined according to the Japanese standard JIS K 5101. Calcined kaolin has proved particularly worthwhile due to its considerable absorption reservoir in the hollow spaces. Mixtures of several different inorganic pigments are also conceivable.

The quantity ratio between organic and inorganic pigment is a combination of the effects caused by the two types of pigment, which is achieved particularly advantageously if the pigment mixture consists of 5 to 30 wt % or better of 8 to 20 wt % of organic and of 95 to 70 wt % or better of 92 to 80 wt % of inorganic pigment. Pigment mixtures of different organic pigments and/or inorganic pigments are conceivable.

According to the invention, a heat-sensitive recording material is preferred, where the interlayer comprises, optionally in addition to the inorganic and/or organic pigments, at least one binder, preferably based on a synthetic polymer, where styrene-butadiene latex delivers particularly good results. The use of a synthetic binder with admixture of at least one natural polymer, such as more preferably starch, is a particularly suitable embodiment. Within the framework of tests using inorganic pigments, it has furthermore been established that a binder-pigment ratio within the interlayer between 3:7 and 1:9, in each case based on wt % in the interlayer, is a particularly suitable embodiment.

According to the invention, a heat-sensitive recording material is preferred, where the colour former is selected from derivatives of compounds from the group consisting of fluoran, phthalide, lactam, triphenylmethane, phenothiazine and spiropyran.

Separate investigations have shown that these colour formers have particularly good properties in combination with the colour developer mixture used according to the invention.

A preferred heat-sensitive recording material of the invention has as colour former, preferably compounds of the fluoran type, selected from the group consisting of 3-diethylamino-6-methyl-7-anilinofluoran, 3-diethylamino-6-methyl-7-(3'-methylphenylamino)fluoran (6'-(diethylamino)-3'-methyl-2'-(m-tolylamino)-3H-spiro [isobenzofuran-1,9'-xanthen]-3-one; ODB-7), 3-di-n-pentyl-amino-6-methyl-7-anilinofluoran, 3-(diethylamino)-6-methyl-7-(3-methylphenylamino)fluoran, 3-di-n-butylamino-7-(2-chloroanilino)fluoran, 3-diethylamino-7-(2-chloroanilino)fluoran, 3-diethylamino-6-methyl-7-xylidinofluoran, 3-diethylamino-7-(2-carbomethoxyphenylamino)fluoran, 3-pyrrolidino-6-methyl-7-anilinofluoran, 3-pyrrolidino-6-methyl-7-(4-n-butyl-phenylamino)fluoran, 3-piperidino-6-methyl-7-anilinofluoran, 3-N-n-dibutylamine-6-methyl-7-anilinofluoran (ODB-2), 3-(N-methyl-N-cyclohexyl)amino-6-methyl-7-anilinofluoran, 3-(N-methyl-N-propyl)amino-6-methyl-7-anilinofluoran, 3-(N-methyl-N-tetrahydrofurfuryl) amino-6-methyl-7-anilinofluoran), 3-(N-ethyl-N-isoamyl) amino-6-methyl-7-anilinofluoran, 3-(N-ethyl-N-tolyl)amino-6-methyl-7-anilinofluoran, 3-(N-ethyl-N-tetrahydrofuryl)amino-6-methyl-7-anilinofluoran, 3-(N-ethyl-N-isopentylamino)-6-methyl-7-anilinofluoran, 3-(N-ethyl-4-toluidino)6-methyl-7-(4-toluidino)fluoran and 3-(N-cyclopentyl-N-ethyl)amino-6-methyl-7-anilinofluoran.

Heat-sensitive recording materials of the invention are likewise preferred which comprise as colour formers the compounds mentioned in paragraphs [0049] to [0052] of EP 2 923 851 A1.

According to the invention, a heat-sensitive recording material is particularly preferred, where the colour former is selected from the group consisting of 3-N-di-n-butylamine-6-methyl-7-anilinofluoran (ODB-2) and 3-(N-ethyl-N-isopentylamino)-6-methyl-7-anilinofluoran.

According to the invention, a heat-sensitive recording material is preferred, where the heat-sensitive recording layer comprises a sensitizer.

When using a sensitizer, the sensitizer is first melted during supply of heat during the printing process and the melted sensitizer dissolves the colour former and colour developer present next to one another in the heat-sensitive recording layer and/or lowers the melting temperature of the colour formers and colour developers to initiate a colour developing reaction. The sensitizer does not take part in the colour developing reaction itself.

A sensitizer is therefore understood to mean substances which serve to set the melting temperature of the heat-sensitive recording layer and with which preferably a melting temperature of about 70 to 80° C. may be set without the sensitizers themselves participating in the colour developing reaction.

According to one aspect of the invention, fatty acid salts, fatty acid esters, and fatty acid amides (for example zinc stearate, stearamide, palmitamide, oleamide, lauramide, ethylene bis stearamide and methylene bis stearamide, methylolstearamide), naphthalene derivatives, biphenyl derivatives, phtalates and terephtalates, may be used as sensitizers.

According to the invention, a heat-sensitive recording material is particularly preferred, where the sensitizer is selected from the group consisting of 1,2-bis(3-methylphenoxy)ethane, 1,2-diphenoxyethane, 1,2-di(m-methylphenoxy)ethane, 2-(2H-benzotriazol-2-yl)-p-cresol, 2,2'-bis(4-methoxyphenoxy)diethyl ether, 4,4'-diallyloxydiphenyl sulfone, 4-acetylacetophenone, 4-benzylbiphenyl, acetoacetanilides, benzyl-2-naphthyl ether, benzyl naphthyl ether, benzyl-4-(benzyloxy)benzoate, benzylparaben, bis(4-chlorobenzyl)oxalate ester, bis(4-methoxyphenyl) ether, dibenzyl oxalate, dibenzyl terephthalate, dimethyl terephthalate, dimethyl sulfone, diphenyl adipate, diphenyl sulfone, ethylene bis stearamide, fatty acid anilides, m-terpenyl, N-hydroxymethylstearamide, N-methylolstearamide, N-stearyl urea, N-stearyl stearamide, p-benzylbiphenyl, phenyl benzenesulfonate ester, salicylanilide, stearamide and α,α'-diphenoxy-xylene, where benzyl naphthyl ether, diphenyl sulfone, 1,2-di(m-methylphenoxy)ethane and 1,2-diphenoxyethane are more preferable.

Heat-sensitive recording materials of the invention are likewise preferred which comprise as sensitizer the compounds mentioned in paragraphs [0059] to [0061] of EP 2 923 851 A1.

According to a first preferred design, these sensitizers are used in each case alone, this means, not in combination with the other said sensitizers from the above list. According to a second, as it were preferred design, at least two sensitizers, selected from the above list, are bound into the heat-sensitive recording layer.

According to the invention, a heat-sensitive recording material is preferred, where the sensitizer has a melting point of 60° C. to 180° C., preferably a melting point of 80° C. to 140° C.

Furthermore, in the heat-sensitive recording materials of the invention, the use of 4,4'-diaminodiphenyl sulfone (4,4'-DDS, Dapson) may be proved as optionally expedient as an additional additive in the heat-sensitive recording layer. The use of 4,4'-diaminodiphenyl sulfone in heat-sensitive papers is described, for example in WO 2014/143174 A1. The invention may in this case then relate to a heat-sensitive recording material, where 4,4'-diaminodiphenyl sulfone is present in the heat-sensitive recording layer, in particular additionally as an additive.

If desired, heat-sensitive recording materials are preferred, where the heat-sensitive recording layer comprises a binder, preferably a crosslinked or uncrosslinked binder selected from the group consisting of polyvinyl alcohol, carboxyl group-modified polyvinyl alcohol, ethylene-vinyl alcohol copolymer, a combination of polyvinyl alcohol and ethylene-vinyl alcohol copolymer, silanol-modified polyvinyl alcohol, diacetone-modified polyvinyl alcohol, acrylate copolymer and film-forming acrylic copolymers.

The coating composition for forming the heat-sensitive recording layer of the heat-sensitive recording material of the invention preferably comprises, in addition to one or more binders, one or more crosslinking agents for the binder or binders. The crosslinking agent is preferably selected from the group consisting of zirconium carbonate, polyamide amine epichlorohydrin resins, boric acid, glyoxal, titanium(IV) bis(ammonium lactato)dihydroxide (CAS No. 65104-06-5; Tyzor® LA) and glyoxal derivatives.

A heat-sensitive recording material of the invention, the heat-sensitive recording layer of which is formed from such a coating composition, containing one or more binders and one or more crosslinking agents for the binder or binders, comprises in the heat-sensitive recording layer one or more binders crosslinked by reaction with one or more crosslinking agents, where the crosslinking agent or crosslinking agents are selected from the group consisting of zirconium carbonate, polyamide amine epichlorohydrin resins, boric acid, glyoxal, titanium(IV) bis(ammonium lactato)dihydroxide (CAS No. 65104-06-5; Tyzor® LA) and glyoxal derivatives. "Crosslinked binder" is thus understood to mean the reaction product formed by reaction of a binder with one or more crosslinking agents.

According to the invention, a heat-sensitive recording material is preferred, where the mass of the heat-sensitive recording layer per unit area is in the range from 1.5 to 6 $g/m^2$, preferably in the range from 2.0 to 5.5 $g/m^2$, more preferably in the range from 2.0 to 4.8 $g/m^2$.

Likewise according to the invention, a heat-sensitive recording material is preferred, where the fraction of colour developer mixture in the heat-sensitive recording layer is 35 to 15 wt %, preferably 31 to 19 wt %, more preferably 28 to 22 wt %, based on the total solids fraction of the heat-sensitive recording layer.

Additionally also image stabilizers, dispersing agents, anti-oxidants, separating agents, defoamers, light stabilizers, brighteners, as are known in the state of the art, may be used in recording materials of the invention. Each of the components is used conventionally in a quantity of 0.01 to 15 wt %, in particular—with the exception of defoamers—0.1 to 15 wt %, preferably 1 to 10 wt %, based on the total solids fraction of the heat-sensitive recording layer. When using defoamers in the formulations regarding this, the defoamer may be present in quantities of 0.03 to 0.05 wt %, based on the total solids fraction of the heat-sensitive recording layer, in the recording materials of the invention.

In one design of the heat-sensitive recording materials of the invention, the heat-sensitive recording layer is wholly or partly covered by a protective layer. Due to the arrangement of a protective layer covering the heat-sensitive recording layer, the heat-sensitive recording layer is also shielded on the outside or towards the supporting substrate of the next layer within a roll so that it effects protection against external influences.

Such a protective layer in such cases, in addition to protection of the heat-sensitive recording layer arranged below the protective layer from environmental influences, often has the additional positive effect of improving the printability of the heat-sensitive recording material of the invention, in particular in indigo printing, offset printing and flexographic printing. For this reason, it may be desirable for certain applications that the heat-sensitive recording material of the invention has a protective layer, although due to the presence of a colour developer mixture as defined above in the heat-sensitive recording layer of the heat-sensitive recording material of the invention, the resistance of a thermal print-out which can be obtained on a heat-sensitive recording material of the invention with respect to materials selected from the group consisting of water, alcohols, greases, oils and mixtures thereof is already adequate even without a protective layer.

The protective layer of the heat-sensitive recording material of the invention preferably comprises one or more crosslinked or uncrosslinked binders selected from the group consisting of carboxyl group-modified polyvinyl alcohols, polyvinyl alcohols modified with silanol groups, diacetone-modified polyvinyl alcohols, partly saponified and completely saponified polyvinyl alcohols and film-forming acrylic copolymers.

If present, the coating composition for forming the protective layer of the heat-sensitive recording material of the invention preferably comprises, in addition to one or more binders, one or more crosslinking agents for the binder or binders. The crosslinking agent is then preferably selected from the group consisting of boric acid, polyamines, epoxy resins, dialdehydes, formaldehyde oligomers, epichlorohydrin resins, adipic acid dihydrazide, melamine formaldehyde, urea, methylol urea, ammonium zirconium carbonate, polyamide epichlorohydrin resins and titanium(IV) bis(ammonium lactato)dihydroxide Tyzor® LA (CAS No. 65104-06-5).

A heat-sensitive recording material of the invention, the protective layer of which is formed from such a coating composition comprising one or more binders and one or more crosslinking agents for the binder or binders, comprises in the protective layer, one or more binders crosslinked by reaction with one or more crosslinking agents, where the crosslinking agent or crosslinking agents are selected from the group consisting of boric acid, polyamines, epoxy resins, dialdehydes, formaldehyde oligomers, epichlorohydrin resins, adipic acid dihydrazide melamine formaldehyde, urea, methylol urea, ammonium zirconium carbonate, polyamide epichlorohydrin resins and titanium(IV) bis(ammonium lactato)dihydroxide Tyzor® LA (CAS No. 65104-06-5). "Crosslinked binder" is thus understood to mean the reaction product formed by reaction of a binder with one or more crosslinking agents.

In a first design variant, the protective layer wholly or partly covering the heat-sensitive recording layer, can be obtained from a coating composition comprising one or more polyvinyl alcohols and one or more crosslinking agents. It is preferred if the polyvinyl alcohol of the protective layer is modified by carboxyl groups or in particular silanol groups. Also mixtures of various carboxyl group-modified or silanol-modified polyvinyl alcohols can preferably be used. Such a protective layer has a high affinity with respect to the preferably UV-crosslinking printing ink used in the offset printing process. This thus crucially assists in fulfilling the requirement for excellent printability within offset printing.

The crosslinking agent or crosslinking agents for the protective layer according to this design variant are preferably selected from the group consisting of boric acid, polyamines, epoxy resins, dialdehydes, formaldehyde oligomers, polyamine epichlorohydrin resin, adipic acid dihydrazide, melamine formaldehyde, and titanium (IV) bis (ammonium lactato)dihydroxide Tyzor® LA (CAS No. 65104-06-5). Mixtures of various crosslinking agents are also possible.

The weight ratio of the modified polyvinyl alcohol to the crosslinking agent in the coating composition for forming the protective layer according to this design variant is preferably in a range from 20:1 to 5:1 and more preferably in a range from 12:1 to 7:1. A ratio of the modified polyvinyl alcohol to the crosslinking agent is more preferably in the range from 100 parts by weight to 8 to 11 parts by weight.

Particularly good results have been achieved if the protective layer according to this design variant additionally comprises an inorganic pigment. The inorganic pigment is thus preferably selected from the group consisting of silicon dioxide, bentonite, aluminium hydroxide, calcium carbonate, kaolin and mixtures of the said inorganic pigments.

It is preferable to apply the protective layer according to this design variant with a mass per unit area in a range from 1.0 g/m$^2$ to 6 g/m$^2$ and more preferably from 1.2 g/m$^2$ to 3.8 g/m$^2$. The protective layer is thus preferably formed as one layer.

In a second design variant, the coating composition for forming the protective layer comprises a water-insoluble, self-crosslinking acrylic polymer as a binder, a crosslinking agent, and a pigment constituent, where the pigment constituent of the protective layer consists of one or more inorganic pigments and at least 80 wt % is formed from a highly purified alkalinized bentonite, the binder of the protective layer consists of one or of several water-insoluble, self-crosslinking acrylic polymers and the binder/pigment ratio is in a range from 7:1 to 9:1.

A self-crosslinking acrylic polymer within the protective layer according to the second design variant described here is preferably selected from the group consisting of styrene-acrylate copolymers, copolymers of styrene and acrylate containing acrylamide groups and copolymers based on acrylonitrile, methacrylamide and acrylic ester. The latter are preferred. Alkalinized bentonite, natural or precipitated calcium carbonate, kaolin, silicic acid or aluminium hydroxide may be bound into the protective layer as pigment. Preferred crosslinking agents are selected from the group consisting of cyclic urea, methylol urea, ammonium zirconium carbonate and polyamide epichlorohydrin resins.

By selecting a water-insoluble, self-crosslinking acrylic polymer as binder and the weight ratio thereof (i) to the pigment being in a range from 7:1 to 9:1 and (ii) to the crosslinking agent being greater than 5:1, even for a protective layer having relatively low mass per unit area, high environmental resistance of the heat-sensitive recording material of the invention is provided. Such weight ratios are thus preferred.

The protective layer itself may be applied by conventional coating mechanisms, for which, inter alia, a coating colour can be used, preferably having a mass per unit area in a range from 1.0 to 4.5 g/m$^2$. In an alternative variant, the protective layer is imprinted. In terms of processing technology and with regard to their technological properties, particularly suitable are those protective layers which can be cured by means of actinic radiation. The term "actinic radiation" is understood to mean UV radiation or ionizing radiation, such as electron radiation.

The appearance of the protective layer is determined crucially by the type of smoothing and the roller surfaces influencing the friction in the smoothing mechanism and calender and materials thereof. In particular due to existing market requirements, a roughness (Parker Print Surf Roughness) of the protective layer of less than 1.5 μm (determined according to the ISO standard 8791, Part 4) is regarded as preferred. The use of smoothing mechanisms, in which NipcoFlex™ rollers or zone-regulated Nipco-P™ rollers are used, have proved particularly worthwhile within the framework of the test work preceding this invention; however, the invention is not restricted thereto.

A second aspect of the present invention relates to a heat-sensitive recording material comprising i) a supporting substrate and ii) a heat-sensitive recording layer, where the heat-sensitive recording layer comprises a colour former and a colour developer mixture, and the colour developer mixture comprises a) a compound of the formula (I)

(I)

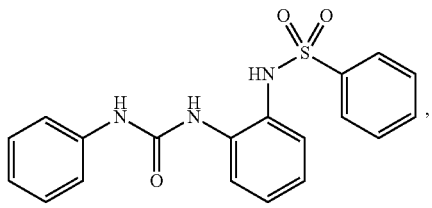

where the compound of the formula (I) is in a crystalline form having an absorption band at 3401±20 cm$^{-1}$ in the IR spectrum, and b) a compound of the formula (II)

(II)

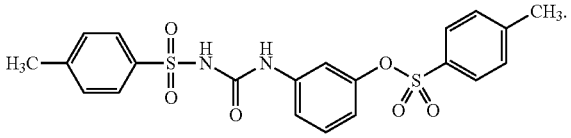

In the paragraphs which follow, which relate to a heat-sensitive recording material of the invention, this second aspect of the present invention will be explained in more detail.

It has been shown, surprisingly, that heat-sensitive recording materials of the invention have significantly improved long-term stability with respect to heat-sensitive recording materials in which the colour developer mixture has been replaced in the same parts by weight by a compound of the formula (I) or a compound of the formula (II). The combination of a compound of the formula (I) with a compound of the formula (II) used according to the invention thus has a synergistic effect which was not foreseeable and therefore is completely surprising.

According to the invention, a heat-sensitive recording material is preferred, where the ageing of the heat-sensitive recording material is less under storage for 24 hours at 90° C. than ageing of a heat-sensitive recording material in which the colour developer mixture has been replaced in the same parts by weight by a compound of the formula (I) or a compound of the formula (II).

Likewise according to the invention, a heat-sensitive recording material is preferred, where the ageing of the heat-sensitive recording material is less under storage for 38 days at 40° C. and 90% relative air humidity than ageing of a heat-sensitive recording material in which the colour developer mixture has been replaced in the same parts by weight by a compound of the formula (I) or a compound of the formula (II).

Ageing of the heat-sensitive recording material is regarded as less if the print density of a printed region decreases less strongly than in the comparison sample.

Surprisingly, it has been shown that recording materials of the invention, in addition to improved long-term stability, also have improved resistance with respect to grease, in particular lanolin, than heat-sensitive recording materials in which the colour developer mixture of the invention has been replaced in the same parts by weight by a compound of the formula (I). The resistance with respect to grease, in particular lanolin, may thus also be better than the grease resistance of a heat-sensitive recording material in which the colour developer mixture of the invention has been replaced in the same parts by weight by a compound of the formula (I) or (II). Accordingly, a synergistic effect is thus also present with regard to the resistance with respect to grease which was not foreseeable and therefore is completely surprising.

According to the invention, a heat-sensitive recording material is preferred, where the resistance of the heat-sensitive recording material with respect to lanolin after 14 days is higher than the resistance of a heat-sensitive recording material in which the colour developer mixture has been replaced in the same parts by weight by a compound of the formula (I).

According to the invention, a heat-sensitive recording material is likewise preferred, where the resistance of the heat-sensitive recording material with respect to lanolin after 14 days is higher than or the same as the resistance of a heat-sensitive recording material in which the colour developer mixture has been replaced in the same parts by weight by a compound of the formula (II).

The resistance of the heat-sensitive recording material with respect to lanolin is regarded as higher if the print density of a printed region decreases less strongly than in the comparison sample.

It is known to the expert that the combination of various developers, such as compounds of the formula (I) or (II), conventionally leads to an impairment of the properties of the heat-sensitive recording material. Conventionally, the combination of two or more developers leads to an undesirable change in the colour of the heat-sensitive recording material so that the heat-sensitive recording material has, for example a grey effect, without the other properties being improved. Accordingly, the expert, to try and provide a heat-sensitive recording material which in the printed state has a high resistance with respect to environmental influences, such as moisture, heat or chemicals, would have not considered combining various developers with one another and not carried out corresponding tests. Also for this reason, the solution of the invention shown here is surprising, since to achieve the object, the expert would have to overcome first of all the technical prejudice that two developers should not be combined with one another.

In one design according to the second aspect of the invention, a heat-sensitive recording material is preferred according to the invention, where the mass ratio between the compound of the formula (I) and the compound of the formula (II) is 0.5:99.5 to 99.5:0.5. It has been shown in separate investigations that for a fraction of less than 0.5 wt % of the compound with the formula (I) or (II), based on the total weight of the compounds with the formula (I) and (II), the positive influence of the respective compound is not so strongly pronounced.

According to the second aspect of the invention, a heat-sensitive recording material is particularly preferred, where the mass ratio between the compound of the formula (I) and the compound of the formula (II) is 35:65 to 65:35, preferably 40:60 to 60:40, more preferably 45:55 to 55:45.

It has been shown in separate investigations that mixtures having a mass ratio between the compound of the formula (I) and the compound of the formula (II) of about 1:1 or in the ranges defined above from 35:65 to 65:35, preferably 40:60 to 60:40, more preferably 45:55 to 55:45, have a synergistic effect both with regard to improved long-term stability and with regard to improved resistance with respect to lanolin. Heat-sensitive recording materials, which have as colour developer mixture, mixtures with these mass ratios, that is, mixtures with the same or approximately the same mass fractions of the compounds of the formula (I) and (II), show better properties than heat-sensitive recording materials in which the colour developer mixture has been replaced in the same parts by weight by only one compound of the formula (II) or (I).

The embodiments described earlier on above of the heat-sensitive recording material of the invention (first aspect of the present invention), in so far as they do not relate to the mass ratio between the compound of formula (I) and the compound of the formula (II), are valid correspondingly for the heat-sensitive recording materials of the invention in accordance with the second aspect of the present invention.

A further aspect of the present invention relates to a use of a heat-sensitive recording material of the invention as entrance tickets, flight, rail, ship or bus ticket, gambling ticket, pay and display ticket, label, till receipt, bank statements, sticker, medical diagram paper, fax paper, security paper or barcode labels.

A further aspect of the present invention relates to products, preferably entrance tickets, flight, rail, ship or bus ticket, gambling ticket, pay and display ticket, label, till receipt, bank statements, sticker, medical diagram paper, fax paper, security paper or barcode labels, comprising a heat-sensitive recording material of the invention.

A further aspect of the present invention relates to a use of a compound of the formula (I)

(I)

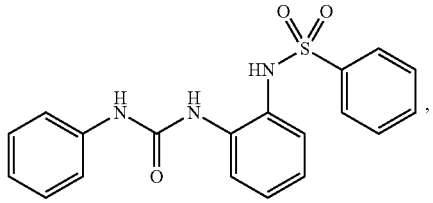

where the compound of the formula (I) is in a crystalline form having an absorption band at 3401±20 $cm^{-1}$ in the IR spectrum, for improving the moisture resistance of a printed image on a heat-sensitive recording material in which a compound of the formula (II)

(II)

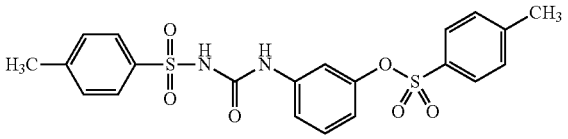

is present as a colour developer, where the mass ratio between the compound of the formula (I) and the compound of the formula (II) is 0.5:99.5 to 35:65, preferably 5:95 to 30:70, more preferably 15:85 to 25:75.

A further aspect of the present invention relates to a use of a compound of the formula (I)

(I)

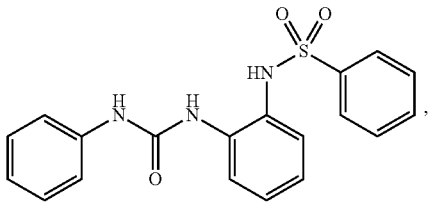

where the compound of the formula (I) is in a crystalline form having an absorption band at 3401±20 $cm^{-1}$ in the IR spectrum, for improving the water resistance (in particular at 40° C. and 90% relative humidity) of a printed image on a heat-sensitive recording material in which a compound of the formula (II)

(II)

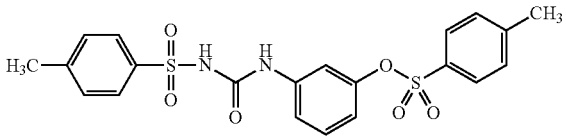

is present as a colour developer, where the mass ratio between the compound of the formula (I) and the compound of the formula (II) is 0.5:99.5 to 99.5:0.5, preferably 35:65 to 65:35, more preferably 40:60 to 60:40, more preferably 45:55 to 55:45.

A further aspect of the present invention relates to a use of a compound of the formula (I)

(I)

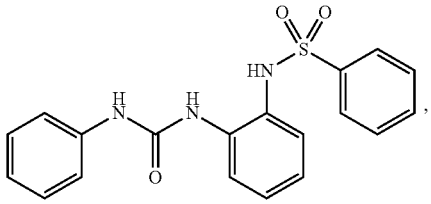

where the compound of the formula (I) is in a crystalline form having an absorption band at 3401±20 $cm^{-1}$ in the IR spectrum, for improving the resistance at 60° C., preferably for more than 24 hours, of a printed image on a heat-sensitive recording material in which a compound of the formula (II)

(II)

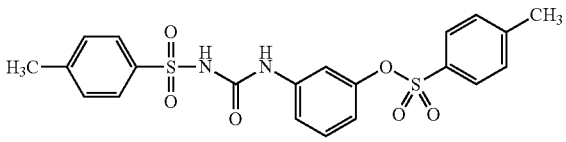

is present as a colour developer, where the mass ratio between the compound of the formula (I) and the compound of the formula (II) is 0.5:99.5 to 35:65, preferably 5:95 to 30:70, more preferably 15:85 to 25:75.

A further aspect of the present invention relates to a use of a compound of the formula (II)

(II)

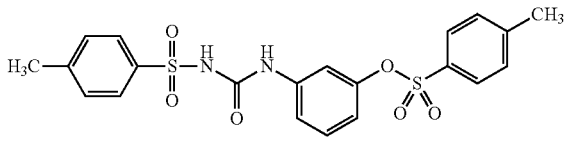

for improving the grease resistance, in particular the resistance with respect to lanolin, of a printed image on a heat-sensitive recording material in which a compound of the formula (I)

(I)

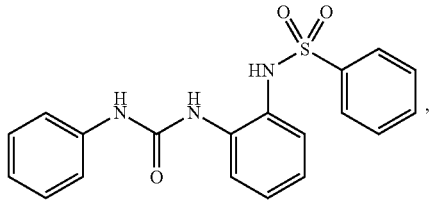

where the compound of the formula (I) is in a crystalline form having an absorption band at 3401±20 $cm^{-1}$ in the IR spectrum, is present as a colour developer, where the mass ratio between the compound of the formula (I) and the compound of the formula (II) is 99.5:0.5 to 65:35, preferably 97:3 to 85:15, more preferably 95:5 to 90:10.

A further aspect of the present invention relates to a method for producing a heat-sensitive recording material, at least comprising the following steps:

i. providing or producing a supporting substrate;

ii. providing or producing a coating composition comprising a compound of the formula (I) as used in a heat-sensitive recording material of the invention and a compound of the formula (II) as used in a heat-sensitive recording material of the invention;

iii. applying the provided or produced coating composition to the provided or produced supporting substrate;

iv. drying the applied coating composition to form a heat-sensitive recording layer.

According to the invention, a method is preferred additionally comprising the steps a) providing or producing a coating composition comprising pigments;

b) application of the provided or produced coating composition to the supporting substrate;

c) drying the applied coating composition to form an interlayer;

where the steps a) to c) are carried out before step ii. and the interlayer is arranged between the supporting substrate and the heat-sensitive recording layer. Provided an interlayer is formed, application of the provided or produced coating composition onto the interlayer formed is effected in step iii. of the method of the invention and not directly onto the provided or produced supporting substrate.

According to the invention, a method is likewise preferred additionally comprising the steps A) providing or producing a coating composition;

B) applying the provided or produced coating composition to the heat-sensitive recording layer;

C) drying the applied coating composition to form a protective layer;

where the steps A) to C) are carried out after step iv. and the protective layer is arranged on the heat-sensitive recording layer.

DETAILED DESCRIPTION OF THE PRESENTLY PREFERRED EMBODIMENTS

Figure 1:
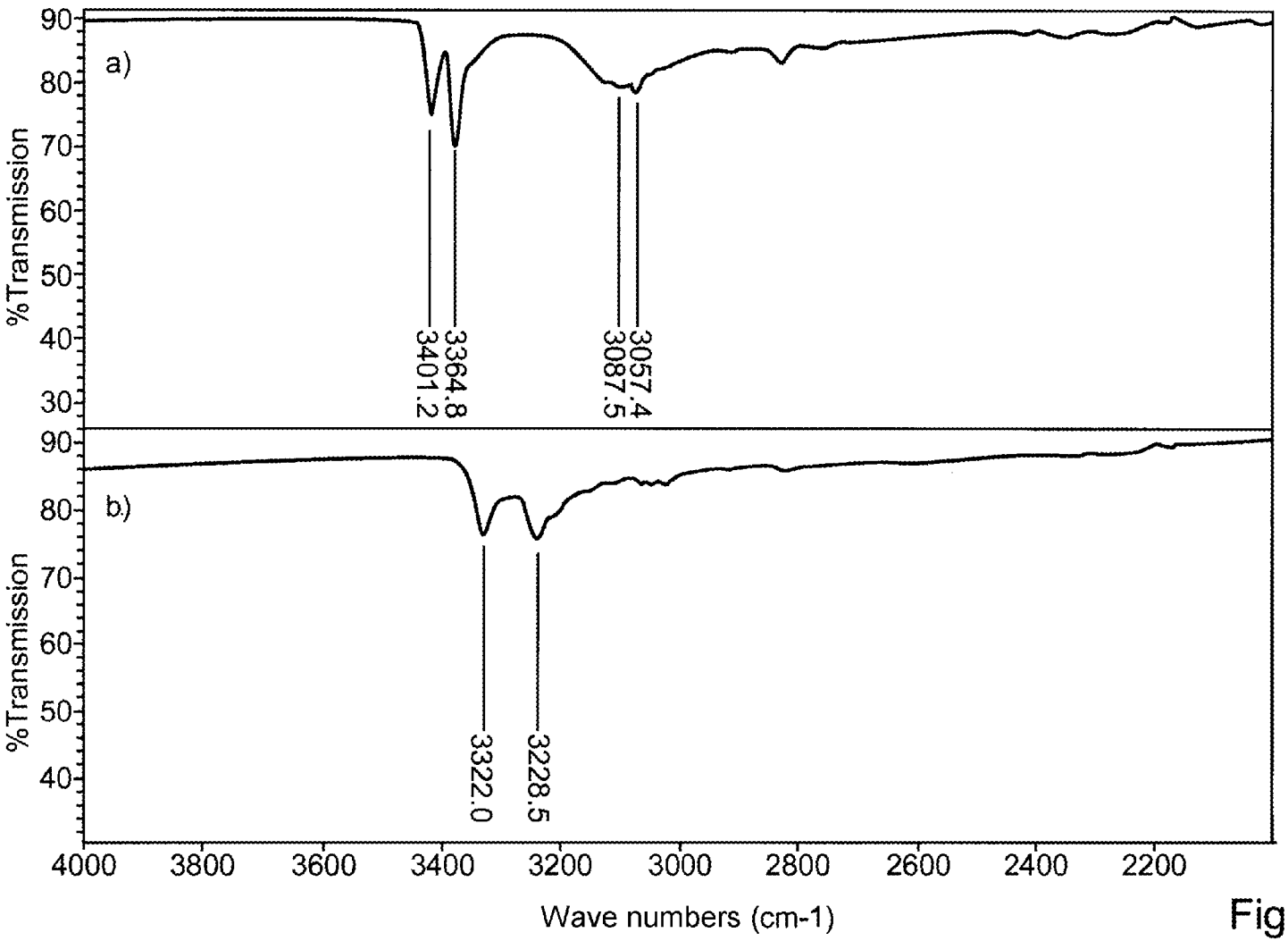
FIG. 1 shows a comparison of IR spectra in the wave number range from about 4000 to 2000 $cm^{-1}$ of the two crystalline forms of the compound of the formula (I)

FIG. 1 shows a comparison of IR spectra in the wave number range from about 4000 to 2000 $cm^{-1}$ of the two crystalline forms of the compound of the formula (I). Shown in the upper part and designated by a) is the IR spectrum of the crystalline form of the compound of the formula (I) used according to the invention having a melting point of 175° C. Shown in the lower part and designated by b) is shown the IR spectrum of the crystalline form of the compound of the formula (I) having a melting point of about 158° C.

Figure 2:
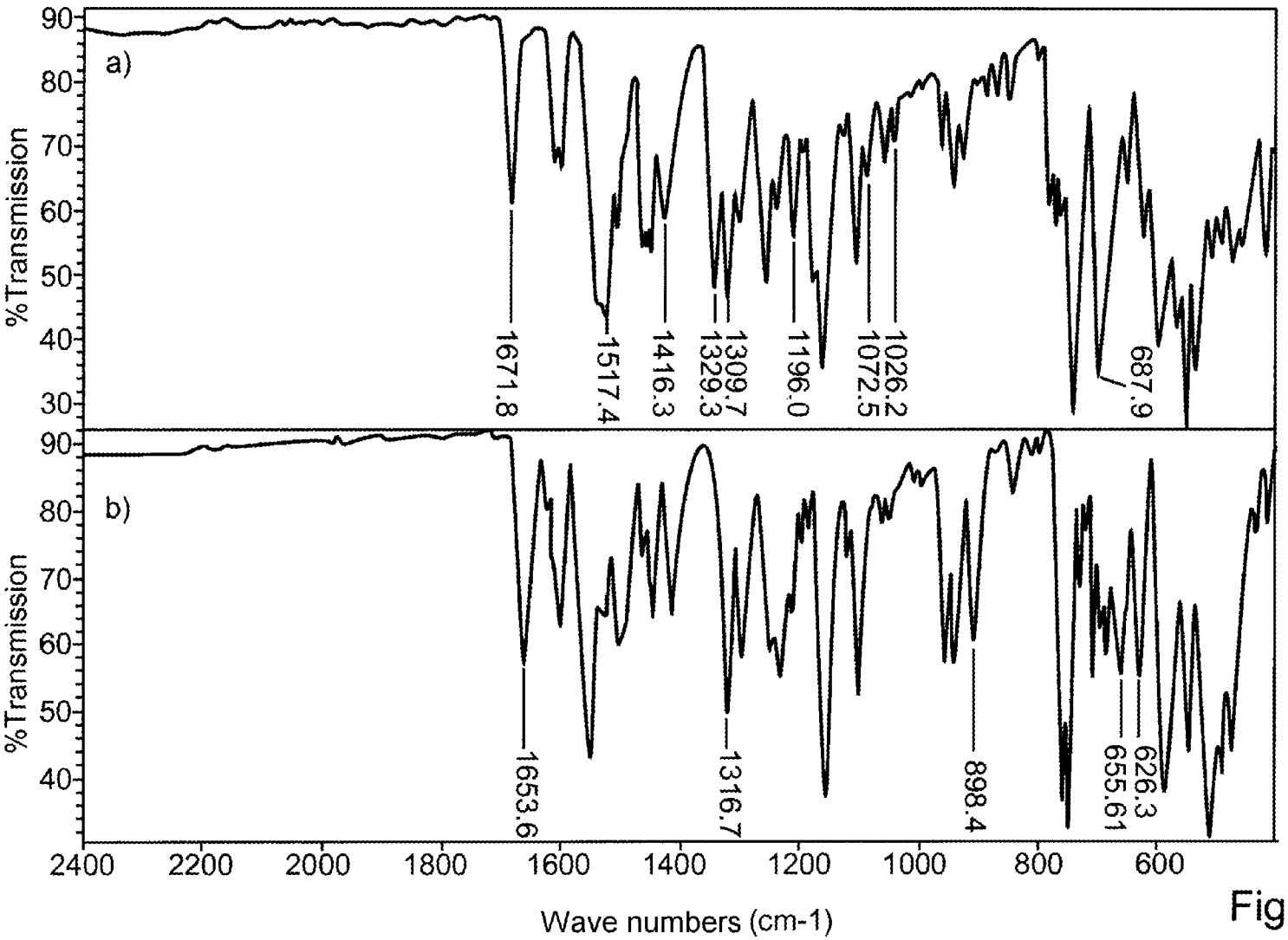
FIG. 2 shows a comparison of IR spectra in the wave number range from about 2400 to 400 $cm^{-1}$ of the two crystalline forms of the compound of the formula (I)

FIG. 2 shows a comparison of IR spectra in the wave number range from about 2400 to 400 $cm^{-1}$ of the two crystalline forms of the compound of the formula (I). Shown in the upper part and designated by a) is the IR spectrum of the crystalline form of the compound of the formula (I) used according to the invention having a melting point of 175° C. Shown in the lower part and designated by b) is shown the IR spectrum of the crystalline form of the compound of the formula (I) having a melting point of about 158° C.

Figure 3:
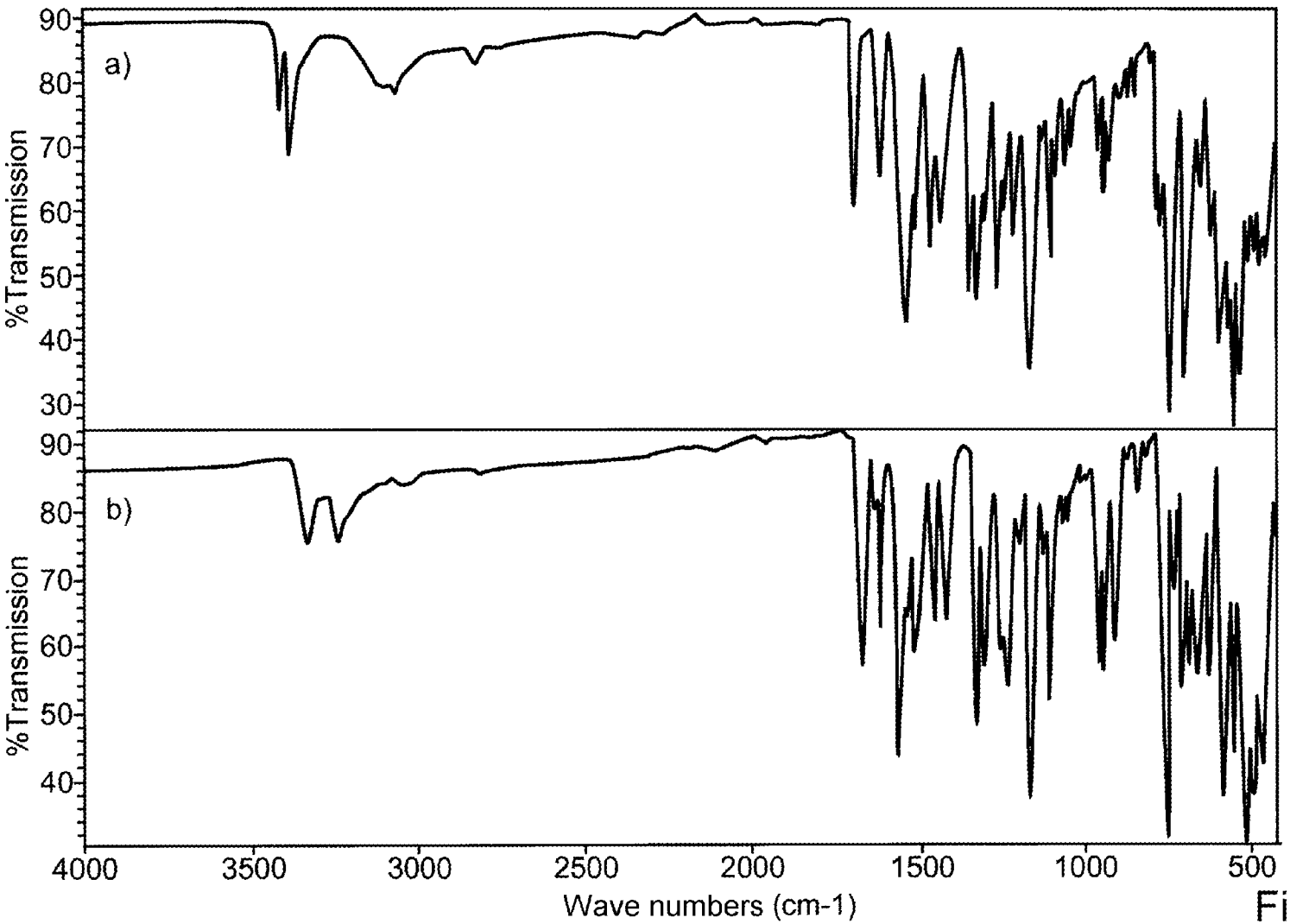
FIG. 3 shows a comparison of IR spectra of the two crystalline forms of the compound of the formula (I)

FIG. 3 shows a comparison of IR spectra of the two crystalline forms of the compound of the formula (I). Shown in the upper part and designated by a) is the IR spectrum of the crystalline form of the compound of the formula (I) used according to the invention having a melting point of 175° C. Shown in the lower part and designated by b) is shown the IR spectrum of the crystalline form of the compound of the formula (I) having a melting point of about 158° C.

Figure 4:
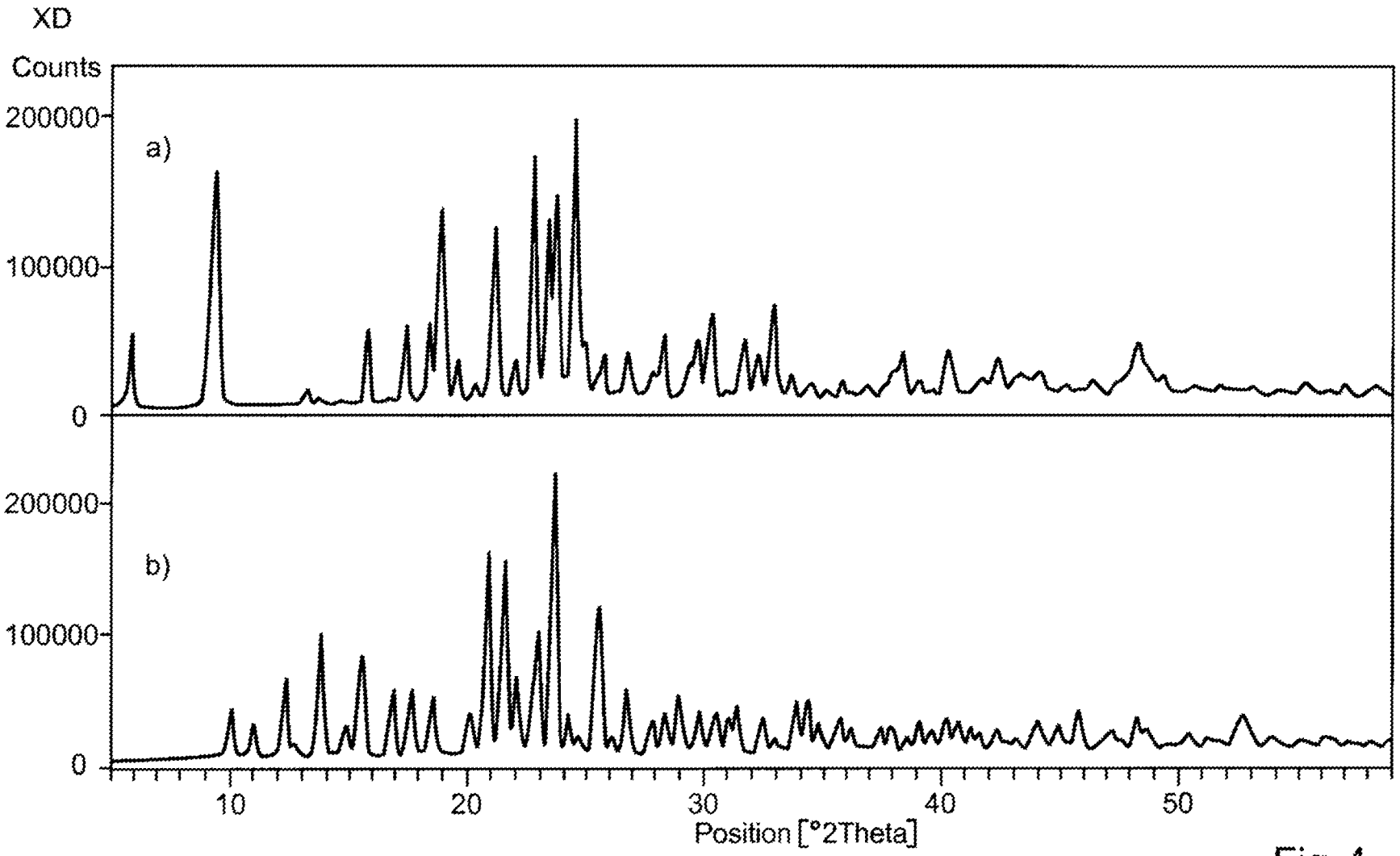
FIG. 4 shows a comparison of X-ray powder diffractograms of the two crystalline forms of the compound of the formula (I)

FIG. 4 shows a comparison of X-ray powder diffractograms of the two crystalline forms of the compound of the formula (I). Shown in the upper part and designated by a) is the X-ray powder diffractogram of the crystalline form of the compound of the formula (I) having a melting point of about 158° C. Shown in the lower part and designated by b) is the X-ray powder diffractogram of the crystalline form of the compound of the formula (I) used according to the invention having a melting point of 175° C.

Figure 5:
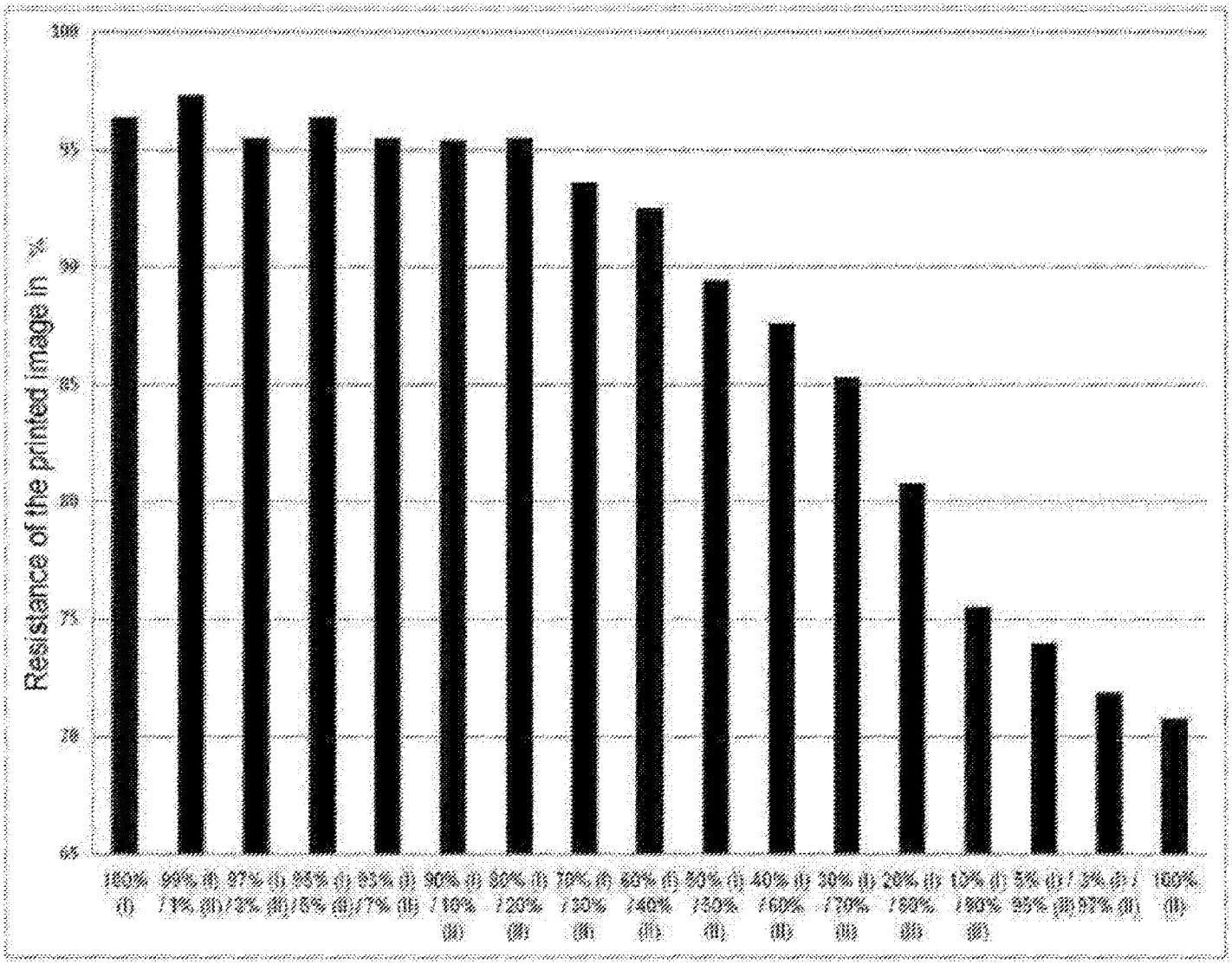
FIG. 5 shows the results of the determination of the long-term climatic resistance of heat-sensitive recording materials (at 40° C. and 90% relative humidity)

FIG. 5 shows the results of the determination of the long-term climatic resistance of heat-sensitive recording materials (at 40° C. and 90% relative humidity). In the diagram shown, resistance of the printed image in % in dependence on the ratio of the compounds of the formulae (I) and (II) is shown.

Figure 6:
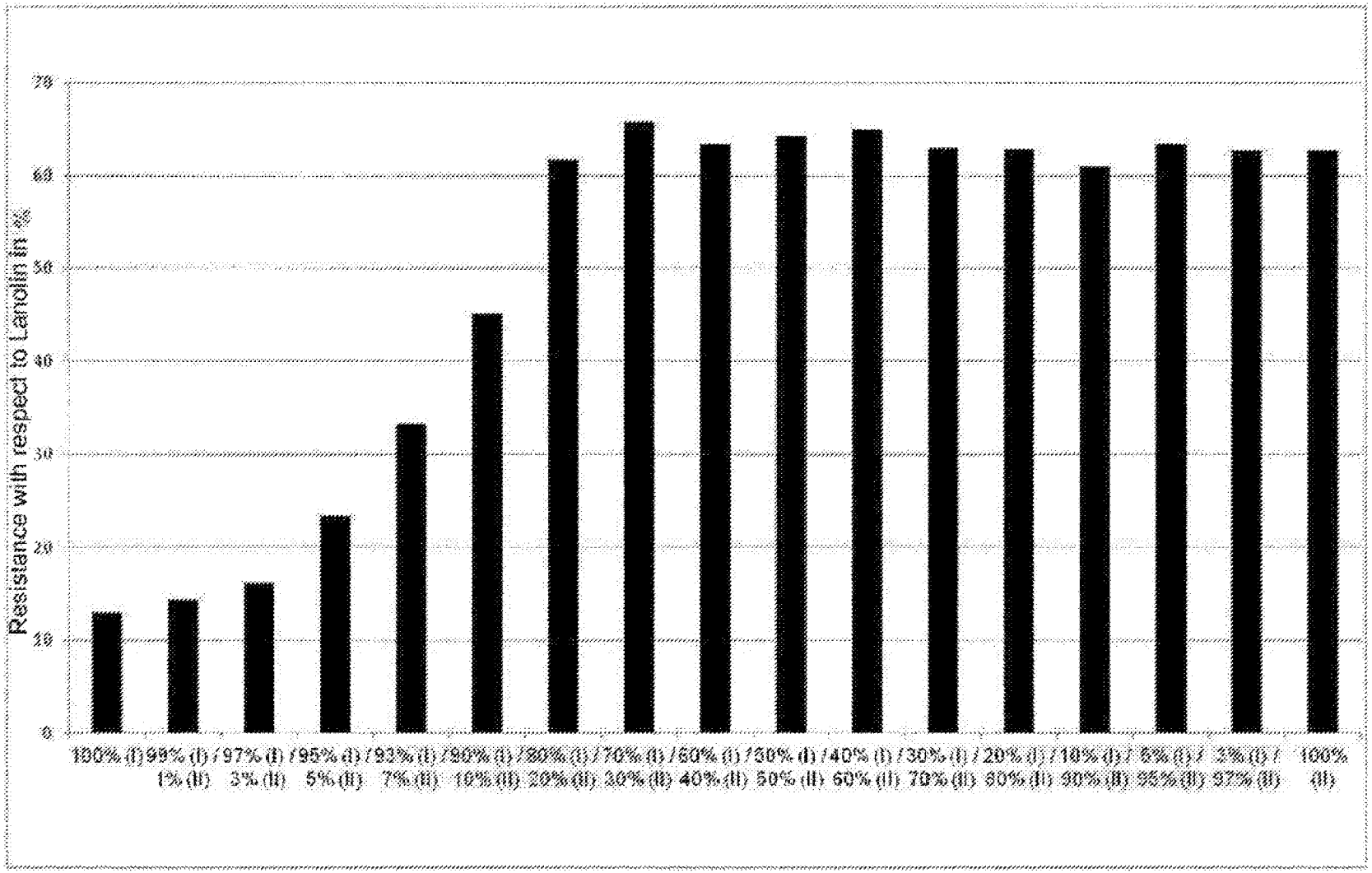
FIG. 6 shows the results of the determination of the resistance of heat-sensitive recording materials with respect to lanolin.

FIG. 6 shows the results of the determination of the resistance of heat-sensitive recording materials with respect to lanolin. In the diagram shown, resistance of the printed image in % in dependence on the ratio of the compounds of the formulae (I) and (II) is shown.

Figure 7:
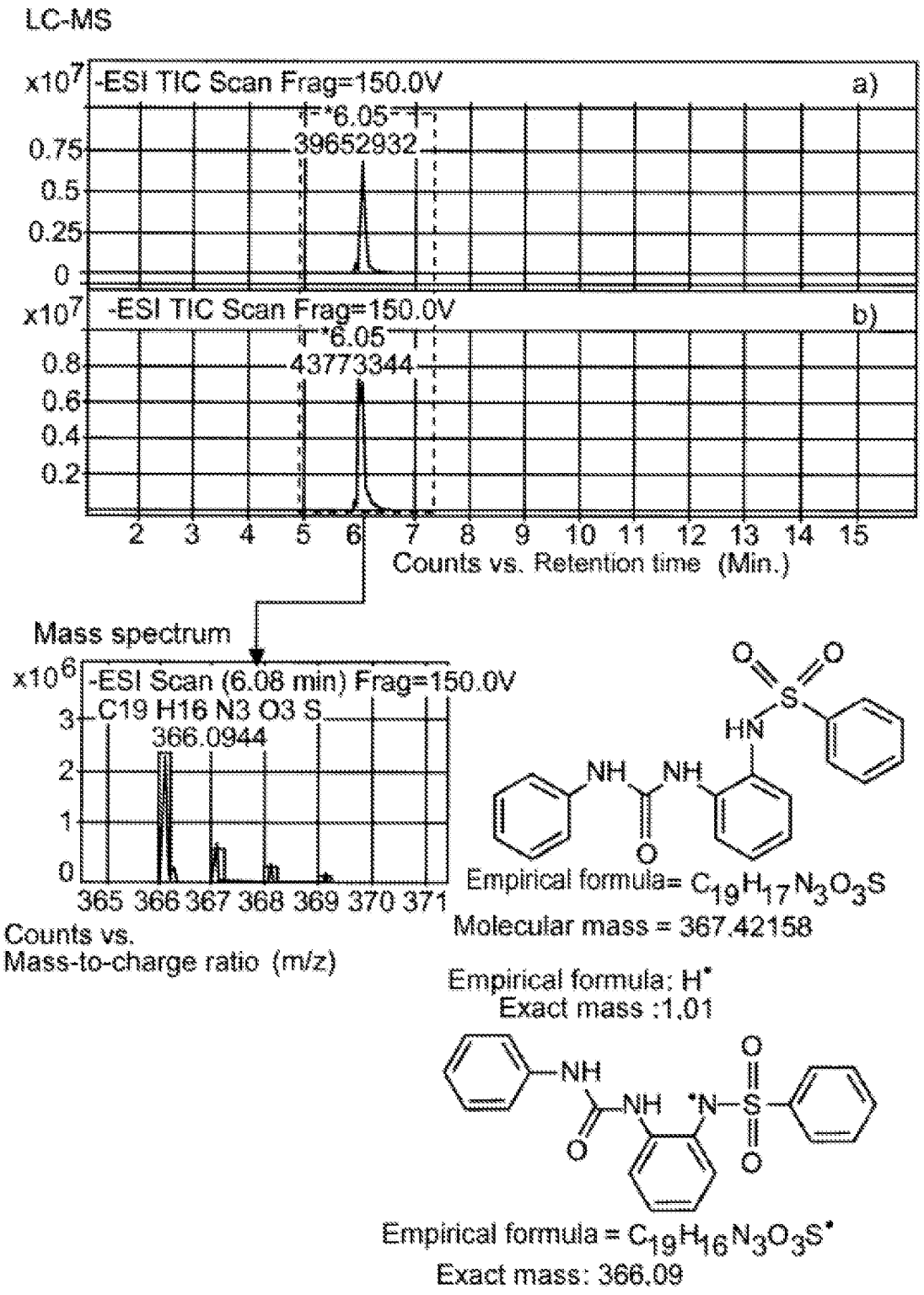
FIG. 7 shows the measured results of a measurement with the assistance of liquid chromatography with mass spectrometry coupling (LC-MS) of the two crystalline forms of the compound of the formula (I)

FIG. 7 shows the measured results of a measurement with the assistance of liquid chromatography with mass spectrometry coupling (LC-MS) of the two crystalline forms of the compound of the formula (I). Shown in the upper part and designated by a) is shown the chromatogram of the crystalline form of the compound of the formula (I) having a melting point of about 158° C. Shown in the lower part and designated by b) is the chromatogram of the crystalline form of the compound of the formula (I) used according to the invention having a melting point of 175° C. It can be seen clearly that both measured compounds of the formula (I) do not contain impurities. In the lower region is shown the mass spectrum of the crystalline form of the compound of the formula (I) used according to the invention having a melting point of 175° C. The base peak (ion peak with the highest intensity) has a molar mass of 366.09 m/z, which corresponds to the molar mass of the compounds of the formula (I) minus $H^{+}$. The formation of solvates or the presence of impurity, which could effect a change in the melting point, may thus be ruled out. In addition, the structures of the compound of the formula (I) and one possible, ionized fragment of the compound of the formula (I) are shown in the lower region.

Figure 8:
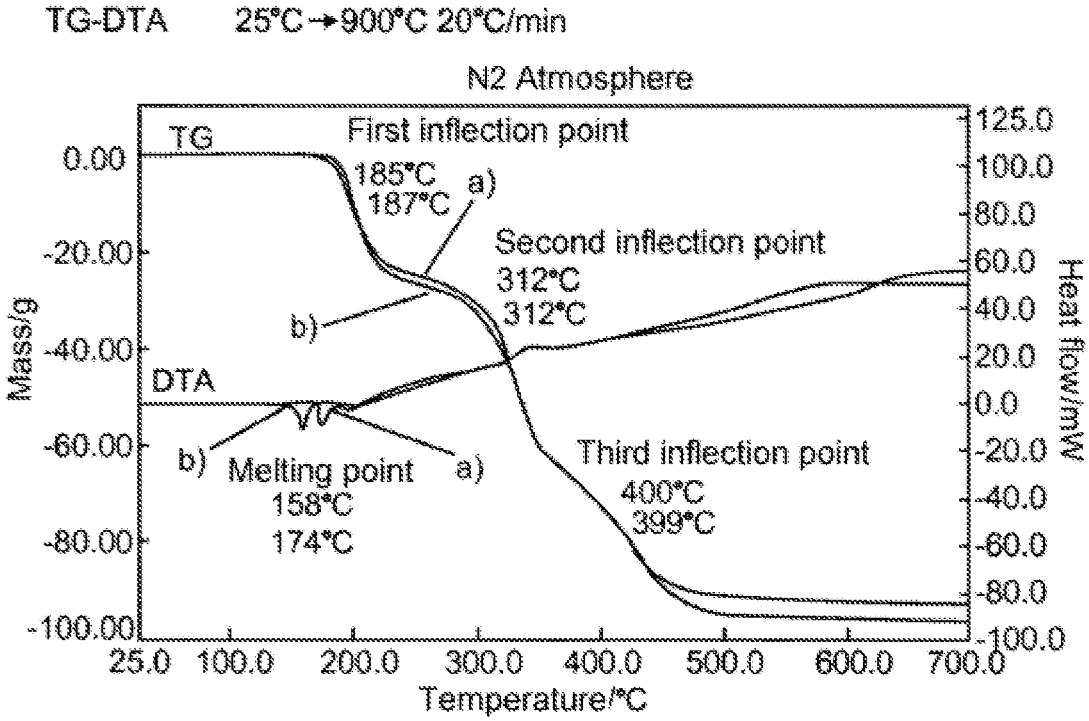
FIG. 8 shows the measured results of a thermal analysis (differential thermoanalysis (DTA) and thermogravimetry (TG)) of the two crystalline forms of the compound of the formula (I)

FIG. 8 shows the measured results of a thermal analysis (differential thermoanalysis (DTA) and thermogravimetry (TG)) of the two crystalline forms of the compound of the formula (I). The lines characterized by a) correspond to the crystalline form of the compound of the formula (I) used according to the invention having a melting point of 175° C. The lines characterized by b) correspond to the crystalline form of the compound of the formula (I) having a melting point of about 158° C. In both crystalline forms of the compound of the formula (I), no mass change in the thermogravimetry trace can be observed up to temperatures of over 150° C. Hence, the presence of solvates may be ruled out, since here evaporation of the solvent with mass change would be observed. The first inflection point in the thermogravimetry trace is at about 186° C. for both compounds. The different melting points at 158° C. or 174° C. may be observed in the differential thermoanalysis.

Figure 9:
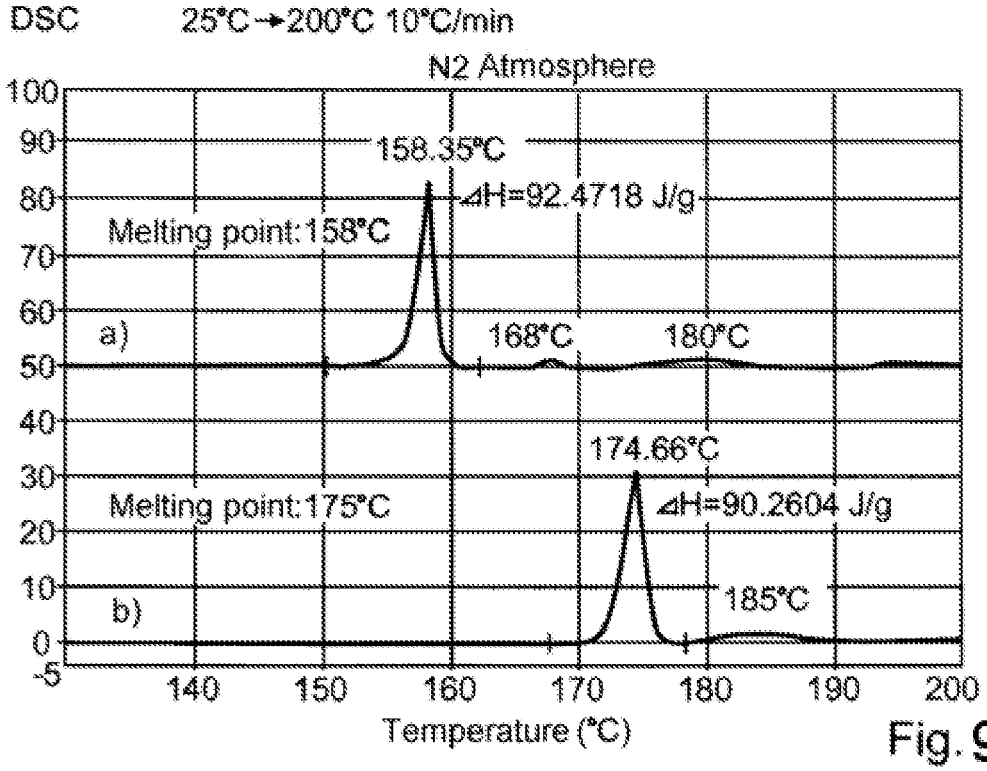
FIG. 9 shows the measured results of a dynamic differential calorimetry measurement (DSC) of the two crystalline forms of the compound of the formula (I)

FIG. 9 shows the measured results of a dynamic differential calorimetry measurement (DSC) of the two crystalline forms of the compound of the formula (I). Shown in the upper part and designated by a) is the trace of the crystalline form of the compound of the formula (I) having a melting point of about 158° C. Shown in the lower part and designated by b) is the trace of the crystalline form of the compound of the formula (I) used according to the invention having a melting point of 175° C. In both crystalline forms of the compound of the formula (I), no enthalpy changes can be observed up to the respective melting point of the compound. Hence, the presence of solvates may be ruled out, since here an enthalpy change during evaporation of the solvent would be observed.

Figure 10:
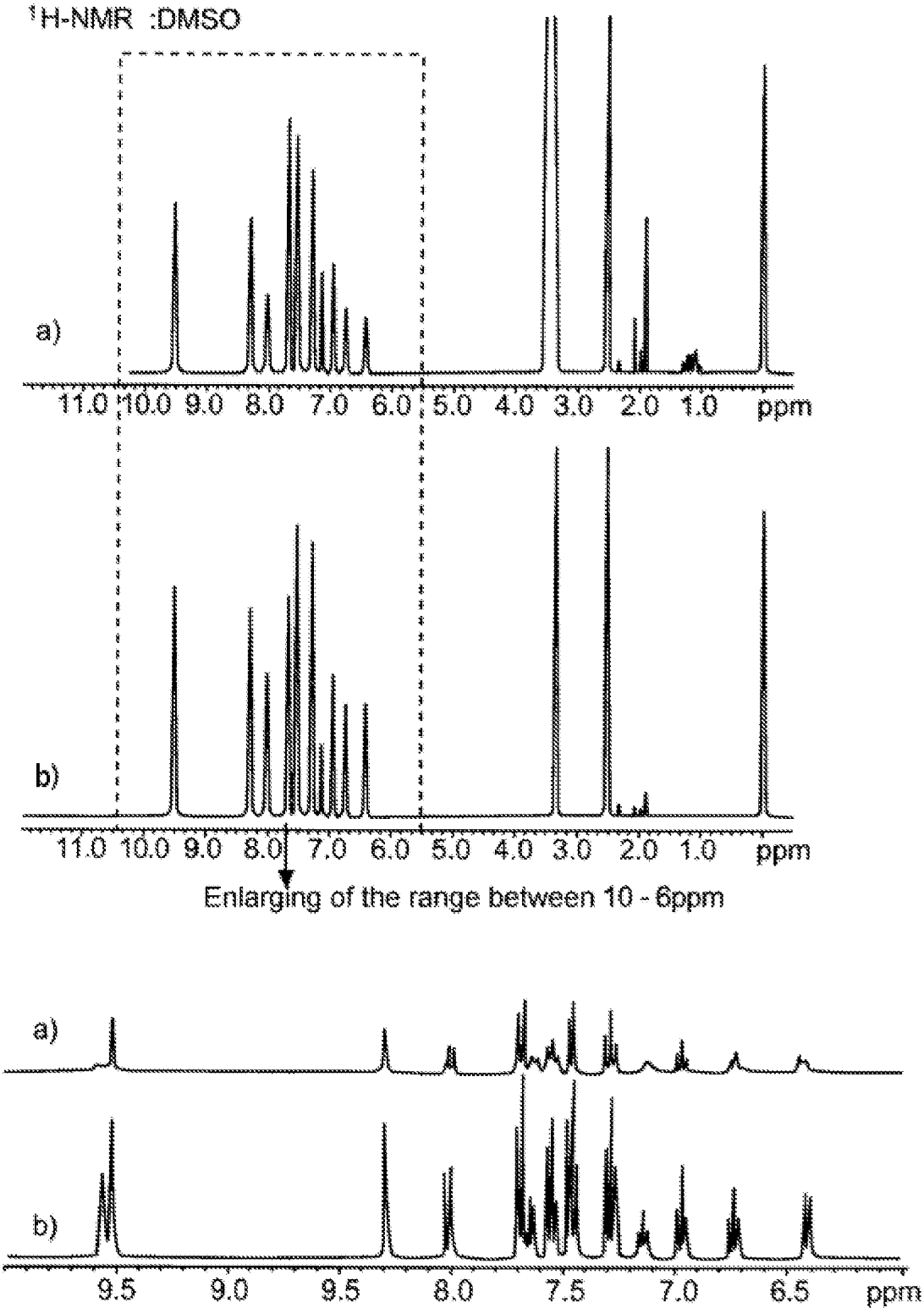
FIG. 10 shows $^{1}$H-NMR spectra of the two crystalline forms of the compound of the formula (I).

FIG. 10 shows $^1$H-NMR spectra of the two crystalline forms of the compound of the formula (I). Shown in the upper part and designated by a) is the $^1$H-NMR spectrum of the crystalline form of the compound of the formula (I) used according to the invention having a melting point of 175° C. Shown in the lower part and designated by b) is shown the $^1$H-NMR spectrum of the compound of the formula (I) having a melting point of about 158° C. Further below in FIG. 10, in each case an enlarged cut-out of the aromatic range from about 10 to 6 ppm is shown. It can be seen clearly that they are the same compounds. The aliphatic signals at about 3.3 ppm and 2.5 ppm are the signals of the solvent deuterated dimethyl sulfoxide DMSO-d5 or mono-deuterated water molecules DOH dissolved therein. In $^1$H-NMR spectroscopy (nuclear magnetic resonance spectroscopy (NMR spectroscopy from the English Nuclear Magnetic Resonance)), the absorption behaviour of $^1$H nuclei is detected.

The examples and comparative examples below will further explain the invention:

Examples 1 to 15 and Comparative Examples 1 and 2

A paper web of bleached and ground deciduous and coniferous pulps with a mass per unit area of 67 g/m$^2$ with addition of conventional additives in conventional quantities is produced as supporting substrate on a fourdrinier paper machine. On the front side an interlayer comprising hollow-space pigments and calcined kaolin as pigment, styrene-butadiene latex as binder and starch as co-binder with a mass per unit area of 9 g/m$^2$ is applied using a roller doctor-knife coating mechanism and dried conventionally.

A heat-sensitive recording layer with a mass per unit area of 6.0 g/m$^2$ is applied to the interlayer by means of roller doctor-knife coating mechanism using a coating machine and dried conventionally after the application.

A formulation, which comprises as binder a mixture comprising polyvinyl alcohol, 3-N-di-n-butylamine-6-methyl-7-anilinofluoran (50 absolutely dry parts by weight) as colour former and an acrylate copolymer and as pigment calcium carbonate, is used for the heat-sensitive recording layer. Further constituents of the heat-sensitive recording layers of the individual exemplary embodiments are indicated in Table 1 below (Examples 1-15 according to the invention):

TABLE 1

| | Compound of the Formula (I) | Compound of the Formula (II) |
|---|---|---|
| Comparative example 1 (not according to the invention) | 100 absolutely dry parts by weight | 0 absolutely dry parts by weight |
| Comparative example 2 (not according to the invention) | 0 absolutely dry parts by weight | 100 absolutely dry parts by weight |
| Example 1 | 99 absolutely dry parts by weight | 1 absolutely dry parts by weight |
| Example 2 | 97 absolutely dry parts by weight | 3 absolutely dry parts by weight |
| Example 3 | 95 absolutely dry parts by weight | 5 absolutely dry parts by weight |
| Example 4 | 93 absolutely dry parts by weight | 7 absolutely dry parts by weight |
| Example 5 | 90 absolutely dry parts by weight | 10 absolutely dry parts by weight |
| Example 6 | 80 absolutely dry parts by weight | 20 absolutely dry parts by weight |
| Example 7 | 70 absolutely dry parts by weight | 30 absolutely dry parts by weight |
| Example 8 | 60 absolutely dry parts by weight | 40 absolutely dry parts by weight |
| Example 9 | 50 absolutely dry parts by weight | 50 absolutely dry parts by weight |
| Example 10 | 40 absolutely dry parts by weight | 60 absolutely dry parts by weight |
| Example 11 | 30 absolutely dry parts by weight | 70 absolutely dry parts by weight |
| Example 12 | 20 absolutely dry parts by weight | 80 absolutely dry parts by weight |
| Example 13 | 10 absolutely dry parts by weight | 90 absolutely dry parts by weight |
| Example 14 | 5 absolutely dry parts by weight | 95 absolutely dry parts by weight |
| Example 15 | 3 absolutely dry parts by weight | 97 absolutely dry parts by weight |

In paper production, three grades of dry content of paper and pulp are differentiated "absolutely dry", "air dry" and "oven dry". The detail is effected in each case in "% absolutely dry", "% air dry" and "% oven dry". Where "absolutely dry" represents a paper or pulp with 0% water content. A "normal" moisture content (basically necessary for the paper) is thus used as the basis of the calculation for "air dry". For pulp and wood pulp, the calculation mass usually relates to 90:100, that is, 90 parts of the material, 10 parts of water. The state of paper or pulp after drying under fixed, defined conditions is designated as "oven dry".

Examples 16 to 30

Examples 16 to 30 were carried out analogously to Examples 1 to 15. However, the interlayer is not applied using a roller doctor-knife coating mechanism, but an outline coating is pulled as an interlayer using a blade.

The heat-sensitive recording layer is applied by means of curtain coating mechanism, where the mass per unit area is 1.5 up to 6.0 g/m$^2$, preferably 2 to 5.5 g/m$^2$. The 3-N-di-n-butylamine-6-methyl-7-anilinofluoran (colour former) is added in a quantity of 40-60 absolutely dry parts by weight. Determination of the Climatic Resistance of Heat-Sensitive Recording Materials (at 40° C. and 90% Relative Humidity for 24 Hours):

To record the climatic resistance of a thermal print-out in terms of measuring technology on the heat-sensitive recording materials of Examples 1 to 15 of the invention and of Comparative example 1, in each case black/white-chequered thermal sample print-outs were generated on the heat-sensitive recording materials to be tested using a device of the type Atlantek 400 from Printrex (USA), where a thermal head with a resolution of 300 dpi and an energy per surface unit of 16 mJ/mm$^2$ was used.

After generating the black/white-chequered thermal sample print-out, after a rest time of more than 5 minutes, a determination of the print density by means of a densitometer TECHKON® SpectroDens Advanced—spectral densitometer was carried out on in each case three points of the black-coloured surfaces and of the uncoloured surfaces of the thermal sample print-out. In each case the average value was formed from the respective measured values of the black-coloured surfaces and of the uncoloured surfaces.

A thermal sample print-out was suspended in a climatic test cabinet at 40° C. and a relative humidity of 90%. After 24 hours, the thermal paper print-out was removed, cooled to room temperature and a determination of the print density by means of a densitometer TECHKON® SpectroDens Advanced—spectral densitometer was carried out again on in each case three points of the black-coloured surfaces and of the uncoloured surfaces of the thermal sample print-out. In each case the average value was formed from the respective measured values of black-coloured surfaces and of the uncoloured surfaces.

The resistance of the printed image in % corresponds to the quotient from the average value of the print density of the coloured surfaces formed before and after the storage in the climatic test cabinet multiplied by 100.

The measured results thus obtained are listed in Table 2 and shown in FIG. 5 (Examples 1-15 according to the invention):

TABLE 2

| Example | Resistance of the printed image in % |
|---|---|
| Example 1 | 97.3 |
| Example 2 | 95.5 |
| Example 3 | 96.4 |
| Example 4 | 95.5 |
| Example 5 | 95.4 |
| Example 6 | 95.5 |
| Example 7 | 93.6 |
| Example 8 | 92.5 |
| Example 9 | 89.4 |
| Example 10 | 87.6 |
| Example 11 | 85.3 |
| Example 12 | 80.8 |
| Example 13 | 75.5 |
| Example 14 | 74.0 |
| Example 15 | 71.9 |
| Comparative example 1 | 96.4 |
| Comparative example 2 (not according to the invention) | 70.8 |

The measured results reproduced in Table 2 show that the climatic resistance of heat-sensitive recording materials (at 40° C. and 90% relative humidity for 24 hours) of Examples 1 to 7 of the invention remains approximately unchanged and the climatic resistance of Examples 11 to 15 of the invention is better than the climatic resistance of Comparative example 2. Through the addition of even small amounts of the compound of the formula (I) to the compound of the formula (II) it is possible to improve significantly the climatic resistance. This improvement in climatic resistance is accomplished, surprisingly, exponentially on addition of the compound of the formula (I).

Determination of the Resistance of Heat-Sensitive Recording Materials with Respect to Lanolin (10 Minutes):

To record the resistance of a thermal print-out in terms of measuring technology on the heat-sensitive recording materials of the examples of the invention and of the comparative examples with respect to lanolin, in each case black/white-chequered thermal sample print-outs were generated on the heat-sensitive recording materials to be tested using a device of the type Atlantek 400 from Printrex (USA), where a thermal head with a resolution of 300 dpi and an energy per surface unit of 16 mJ/mm$^2$ was used.

After generating the black/white-chequered thermal sample print-outs, after a rest time of more than 5 minutes, a determination of the print density by means of a densitometer TECHKON® SpectroDens Advanced—spectral densitometer was carried out on three points of the black-coloured surfaces and of the uncoloured surfaces of the thermal sample print-outs. The average value was formed in each case from the respective measured values of the black-coloured surfaces and of the uncoloured surfaces.

Subsequently, the generated thermal sample print-out of the heat-sensitive recording material to be tested was coated fully with lanolin. After an action time of 10 minutes, the lanolin is carefully wiped away and there was a determination of the print density by means of a densitometer TECHKON® SpectroDens Advanced—spectral densitometer again on in each case three points of the black-coloured surfaces and of the uncoloured surfaces of the thermal sample print-outs. In each case the average value was formed from the respective measured values of the black-coloured surfaces and of the uncoloured surfaces.

The resistance with respect to lanolin in % corresponds to the quotient from the average value of the print density formed before the lanolin treatment and after the lanolin treatment multiplied by 100.

The measured results thus obtained are listed in Table 3 and shown in FIG. 6 (Examples 1-15 according to the invention):

TABLE 3

| Example | Resistance with respect to lanolin in % |
|---|---|
| Example 1 | 14.3 |
| Example 2 | 16.2 |
| Example 3 | 23.3 |
| Example 4 | 33.3 |
| Example 5 | 45.1 |
| Example 6 | 61.7 |
| Example 7 | 65.8 |
| Example 8 | 63.4 |
| Example 9 | 64.2 |
| Example 10 | 64.9 |
| Example 11 | 63.0 |
| Example 12 | 62.9 |
| Example 13 | 61.0 |
| Example 14 | 63.4 |
| Example 15 | 62.7 |
| Comparative example 1 (not according to the invention) | 13.0 |
| Comparative example 2 (not according to the invention) | 62.7 |

The measured results reproduced in Table 3 show that the resistance of the printed image to lanoline in the case of Examples 11 to 15 of the invention does not change significantly and exhibits very good values between 61 and 63.4%. This is surprising because the expert would assume that the addition of the compound of the formula (I) would bring about an impairment in the lanoline resistance. The resistance of the printed image to lanoline in the case of Examples 1 to 7 of the invention is better than the resistance of a printed image in which the colour developer mixture has been replaced in equal parts by weight by a compound of the formula (I) (Comparative example 1). Through the addition even of small amounts of the compound of the formula (II) to the compound of the formula (I) it is possible to improve significantly the resistance to lanoline. Surprisingly, the improvement in the resistance of the printed image to lanoline is exponential in the case of recording materials of the invention.

Resistance to Water and Aqueous Ethanol Solutions (23° C., 50% Relative Humidity, 24 hours):

The resistance of the image generated on the recording layer to water and aqueous solutions is assessed with the aid of these tests. One drop of distilled water or the selected aqueous 25% strength ethanol solution is applied to the printed surfaces generated using the printer ATLANTEK Model 400—Thermal Response Test System with the energy level Medium Stage 10. The excess test liquid is blotted after 20 minutes action time using a filter paper or cotton cloth and the test sheet is then stored for 24 hours at room climate (23° C., 50% relative moisture). Before applying the respective test liquid and after lapsing of the storage time, the optical density of the printed surfaces and the difference thereof is determined using the densitometer TECHKON® SpectroDens Advanced—spectral densitometer.

The resistance with respect to water or aqueous ethanol solutions corresponds to the quotient from the average value of the print density formed before and after the treatment with the respective test liquid multiplied by 100.

The measured results thus obtained are listed in Tables 4 and 5 below:

TABLE 4

Results of the resistance test to water and aqueous ethanol solutions (Part 1) (Comparison represents Comparative example)

| Example No.: | 11 | 12 | 13 | 14 | 15 | Comparison 1 | Comparison 2 | 1 | 2 |
|---|---|---|---|---|---|---|---|---|---|
| Water resistance (23° C., 50% relative humidity, 24 h): | | | | | | | | | |
| Resistance | 83.5 | 83.5 | 82.8 | 82.7 | 83.3 | 86.8 | 82.4 | 85.7 | 87.2 |
| Resistance to 25% strength aqueous ethanol solution (23° C., 50% relative humidity, 24 h): | | | | | | | | | |
| Resistance | 81.7 | 81.1 | 78.8 | 79.6 | 78.4 | 81.7 | 79.2 | 79.7 | 80.3 |

TABLE 5

Results of the resistance test to water and aqueous ethanol solutions (Part 2) (Comparison represents Comparative example)

| Example No.: | 3 | 4 | 5 | 6 | 7 | 8 | 9 | 10 |
|---|---|---|---|---|---|---|---|---|
| Water resistance (23° C., 50% relative humidity, 24 h): | | | | | | | | |
| Resistance | 87.2 | 87.7 | 88.6 | 84.3 | 87 | 90.3 | 83.6 | 83.8 |
| Resistance to 25% strength aqueous ethanol solution (23° C., 50% relative humidity, 24 h): | | | | | | | | |
| Resistance | 82.1 | 82.6 | 84.2 | 85.2 | 84.3 | 85 | 83.6 | 81.1 |

The reproduced measured results show that the resistance of the printed image with respect to water and aqueous ethanol solution in Examples 1 to 15 of the invention has not diminished compared to Comparative examples 1 and 2.

Production of the Crystalline Form Used According to the Invention of the Compound with the Formula (I):

The commercially available compound of the formula (I) having a melting point of about 158° C. is recrystallized from ethanol. The compound of the formula (I) used according to the invention having a melting point of about 175° C. is obtained. The compound of the formula (I) used according to the invention has an absorption band at 3401±20 cm−1 in the IR spectrum.

The compound of the formula (I) obtained by recrystallization from ethanol is characterized by means of $^1$H-HMR spectroscopy in DMSO-D6 as solvent. The $^1$H-HMR spectrum of the compound of the formula (I) produced by recrystallization does not differ from the $^1$H-HMR spectrum of the starting compound. This is also not to be expected, since after resolving the crystalline forms in DMSO-D6, solids are no longer present. However, it may be ruled out by the investigation that during recrystallization an unexpected chemical reaction—for example with ethanol—has taken place or that solvates were formed. Solvates with ethanol would be able to be detected by the presence of additional signals in the $^1$H-NMR (triplet at about 1.06 ppm ($CH_3$), quartet at about 3.44 ppm ($CH_2$) and an OH signal at about 3.39 ppm), which is not the case here.

In the thermogravimetric analysis (TGA) of the compound of the formula (I) obtained by recrystallization from ethanol, no mass change is shown when heating the sample in the temperature range between 25 and 150° C. For impurities with volatile compounds, such as for example ethanol, a mass change of the sample would have been observable at the boiling point of the volatile compound, since the volatile compound boils and thus escapes from the sample and thus leads to a drop in mass. This is not the case here. The results of the thermogravimetric analysis are shown in FIG. 8.

Even for measurements by dynamic differential calorimetry (DSC), in the compound of the formula (I) obtained by recrystallization from ethanol no exothermic or endothermic processes or phase changes may be observed up to a temperature of over 170° C. The first phase change during heating corresponds to the melting point of the compound produced at 175° C. In the presence of solvates, in dynamic differential calorimetry a corresponding phase change would have been observable, for example if the boiling point of the solvating compound is achieved. Presence of solvates may therefore be ruled out in the present case. The results of dynamic differential calorimetry are shown in FIG. 9.

Both a sample of the starting compound and a sample of the crystalline form of the compound of the formula (I) produced by recrystallization from ethanol was investigated with assistance of liquid chromatography with mass spectrometry coupling (LC-MS). In the investigation, no impurities could be detected in either sample and both compounds had the identical molar mass, with identical isotope distribution. The results of liquid chromatography with mass spectrometry coupling are shown in FIG. 7.

The investigations show that it is possible to convert the commercially available compound of the formula (I) or that described in WO 2014/080615 A1 having a melting point of about 158° C. into the compound of the formula (I) used according to the invention having a melting point of about 175° C. by recrystallization from ethanol. In the compound of the formula (I), polymorphy may be detected by these tests, that is, it is a substance which may occur in different modes (modifications). They have the same chemical composition (stoichiometry), but differ in the spatial arrangement of the molecules and have different physical properties. These investigations may rule out the fact that an undesirable chemical reaction of the compound has taken place or that solvates were present after recrystallization.

In addition to recrystallization from ethanol, it is also possible to use other solvents to reach a compound of the formula (I) used according to the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A heat-sensitive recording material, comprising:

i) a supporting substrate; and ii) a heat-sensitive recording layer, comprising:

a colour former; and a colour developer mixture, that comprises:

a) a compound of a formula (I)

(I)

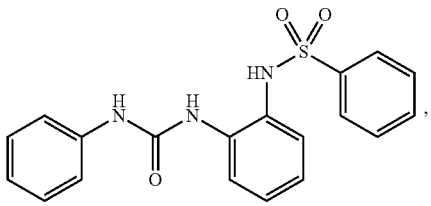

where the compound of the formula (I) is in a crystalline form having an absorption band at 3401±20 $cm^{-1}$ in an IR spectrum, and b) a compound of a formula (II)

(II)

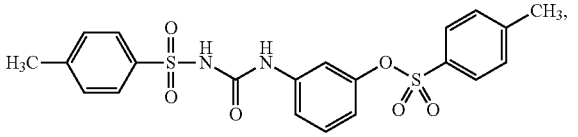

wherein i) a mass ratio between the compound of the formula (I) and the compound of the formula (II) is at least one of:
0.5:99.5 to 35:65,
5:95 to 30:70, and
15:85 to 25:75 or ii) the mass ratio between the compound of the formula (I) and the compound of the formula (II) is at least one of:
99.5:0.5 to 65:35,
97:3 to 85:15, and
95:5 to 90:10.

2. The heat-sensitive recording material according to claim 1, wherein a fraction of the colour developer mixture in the heat-sensitive recording layer is at least one of:
35 to 15 wt %,
31 to 19 wt %, and
28 to 22 wt %,
based on a total solids fraction of the heat-sensitive recording layer.

3. The heat-sensitive recording material according to claim 1, wherein a mass of the heat-sensitive recording layer per unit area is in a range from at least one of:
1.5 to 6 $g/m^2$, and
2.0 to 5.5 $g/m^2$.

4. The heat-sensitive recording material according to claim 1, further comprising:
an interlayer located between the supporting substrate and the heat-sensitive recording layer.

5. The heat-sensitive recording material according to claim 4,
wherein the interlayer comprises pigments and
wherein the pigments are:
a) organic pigments,
and/or
b) inorganic pigments.

6. The heat-sensitive recording material according to claim 1, wherein the heat-sensitive recording layer is at least in part covered by a protective layer.

7. The heat-sensitive recording material according to claim 1, wherein the heat-sensitive recording material is configured as one of a flight ticket, a rail ticket, a ship ticket, a bus ticket, a gambling ticket, a pay and display ticket, a label, a till receipt, a sticker, a medical diagram paper, fax paper, and a barcode label.

8. The heat-sensitive recording material according to claim 4, wherein the interlayer comprises pigments.

9. Heat-sensitive recording material according to claim 5,
wherein the interlayer comprises pigments and
wherein:
the organic pigments are organic hollow-body pigments,
and/or
the inorganic pigments, are selected from the list consisting of calcined kaolin, silicon oxide, bentonite, calcium carbonate, aluminium oxide, and boehmite.

10. A heat-sensitive recording material comprising:

i) a supporting substrate; and ii) a heat-sensitive recording layer, comprising:

a colour former; and a colour developer mixture, that comprises:

a) a compound of a formula (I)

(I)

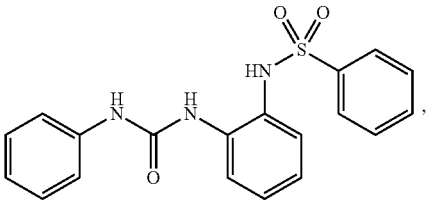

where the compound of the formula (I) is in a crystalline form having an absorption band at 3401±20 $cm^{-1}$ in an IR spectrum, and b) a compound of a formula (II)

(II)

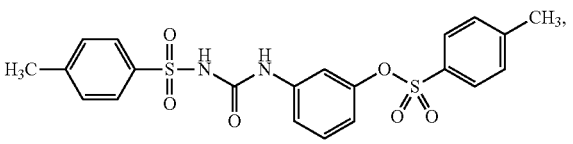

wherein the compounds of formula (I) and formula (II) improve the moisture resistance or lanolin resistance of a printed image of the heat-sensitive recording material, wherein:

i) the mass ratio between the compound of the formula (I) and the compound of the formula (II) is at least one of:

0.5:99.5 to 35:65,

5:95 to 30:70, and

15:85 to 25:75 or ii) the mass ratio between the compound of the formula (I) and the compound of the formula (II) is at least one of:

99.5:0.5 to 65:35,

97:3 to 85:15, and

95:5 to 90:10.

11. A method for producing a heat-sensitive recording material, comprising:

i) providing or producing a supporting substrate;

ii) providing or producing a coating composition comprising a compound of a compound of the formula (I)

(I)

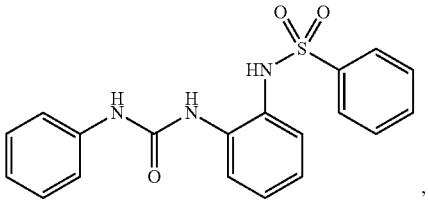

where the compound of the formula (I) is in a crystalline form having an absorption band at 3401±20 $cm^{-1}$ in an IR spectrum, and b) a compound of the formula (II)

(II)

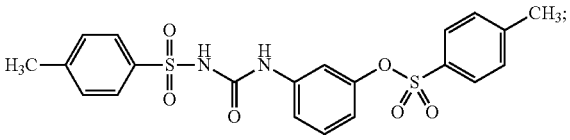

iii) applying the coating composition provided or produced to the supporting substrate; and iv) drying the applied coating composition to form a heat-sensitive recording layer, wherein i) a mass ratio between the compound of the formula (I) and the compound of the formula (II) is at least one of:

0.5:99.5 to 35:65,

5:95 to 30:70, and

15:85 to 25:75 or ii) the mass ratio between the compound of the formula (I) and the compound of the formula (II) is at least one of:

99.5:0.5 to 65:35,

97:3 to 85:15, and

95:5 to 90:10.

* * * * *